US005957816A

United States Patent [19]

Staffa

[11] Patent Number: 5,957,816

[45] Date of Patent: Sep. 28, 1999

[54] EXERCISE APPARATUS FOR STIMULATING MUSCLE COORDINATION AND JOINT STABILITY DURING MULTIAXIAL MOVEMENT PATTERNS INVOLVING ROTATIONAL FORCE

[76] Inventor: Daniel Louis Staffa, 5374 Broadway, Oakland, Calif. 94618

[21] Appl. No.: 08/833,848

[22] Filed: Apr. 10, 1997

[51] Int. Cl.[6] ..... A63B 26/00

[52] U.S. Cl. ..... 482/70; 482/79; 482/44; 482/126

[58] Field of Search ..... 482/70, 79, 44, 482/49, 121, 126; 434/254, 255

[56] References Cited

U.S. PATENT DOCUMENTS

| | | | |
|---|---|---|---|
| 1,585,748 | 5/1926 | Wendelken | 482/146 |
| 2,014,192 | 11/1935 | Stoker | 482/55 |
| 2,707,465 | 2/1955 | Nemath | 482/146 |
| 2,760,774 | 8/1956 | Perez . | |
| 3,345,067 | 10/1967 | Smith . | |
| 3,544,103 | 12/1970 | Conable . | |
| 3,650,528 | 3/1972 | Natterer . | |
| 4,509,747 | 4/1985 | Martin . | |
| 4,645,204 | 2/1987 | Berger . | |
| 4,799,475 | 1/1989 | Iams et al. . | |
| 4,822,207 | 4/1989 | Kascak . | |
| 4,830,363 | 5/1989 | Kennedy | 434/254 |
| 4,842,272 | 6/1989 | Jennings . | |
| 5,031,906 | 7/1991 | Jang . | |
| 5,129,872 | 7/1992 | Dalton et al. . | |
| 5,141,483 | 8/1992 | Smith | 482/142 |
| 5,232,426 | 8/1993 | Van Straaten . | |
| 5,269,737 | 12/1993 | Sobotka | 482/123 |
| 5,279,530 | 1/1994 | Hess . | |
| 5,391,134 | 2/1995 | Heatwole | 482/146 |
| 5,395,296 | 3/1995 | Webster et al. . | |
| 5,435,801 | 7/1995 | Hung . | |
| 5,453,065 | 9/1995 | Lien et al. . | |
| 5,713,823 | 2/1998 | Walendzak | 482/142 |

*Primary Examiner*—Jerome W. Donnelly
*Attorney, Agent, or Firm*—Adam H. Tachner; Crosby, Heafey, Roach & May

[57] ABSTRACT

An exercise apparatus for stimulating muscle coordination and joint stability through multiaxial movement patters involving rotation force is provided. A plurality of methods of use of the apparatus are presented as well to maximize the therapeutic and preventative benefit of the apparatus. A variety of embodiments, including a portable version, are described.

17 Claims, 31 Drawing Sheets

EXERCISE APPARATUS FOR STIMULATING MUSCLE COORDINATION AND JOINT STABILITY DURING MULTIAXIAL MOVEMENT PATTERNS INVOLVING ROTATIONAL FORCE

FIELD OF THE INVENTION

The present invention relates generally to devices using dynamic therapeutic movement for rehabilitation of the shoulder, hip, knee, back and abdominal musculature.

BACKGROUND OF THE INVENTION

The importance of therapeutic exercise is widely accepted for a variety of human disabilities. Exercise plays a crucial role in the rehabilitation of patients suffering from various injuries. Physical therapists regularly provide rehabilitative professional care that individually tailors exercise programs to meet a patient's needs. Rehabilitative exercise programs differ depending on the type and amount of damage to the injured area, stage of tissue healing, age of the person, and level of function of the individual prior to injury.

In many cases, lack of exercise is a contributing factor, if not the primary predisposing factor influencing injury in an adult. The human body was meant to move. As people get older they move less and sit more. Movement increases blood supply which facilitates greater nutrients to muscle and bone and maintains the health of the living tissue. The lack of movement results in poor distribution of nutrients to muscle and bone and the body in general becomes weaker and more susceptible to injury. Hospital studies have shown that a person on continuous bed rest can lose up to thirty percent of their lean body mass in just three weeks.

When a person becomes unaccustomed to strenuous chores after a long winter, and then spends a spring weekend strenuously working in the yard digging holes, planting flowers and pulling weeds, that person will likely find himself taking aspirin and complaining of an aching shoulder, back or both to recover from the resulting pain. Sometimes the soreness goes away, but all too often the soreness persists and requires medical attention.

Regular exercise may keep the body in good shape, but not all exercise is equally effective. In fact, many exercise devices on the market, particularly in health and athletic clubs, are less effective than patrons may assume. That is not to say that the majority of the exercise equipment in the health clubs is not beneficial when used with the guidance of a trainer. The problem is that most available equipment in health clubs train in predominantly linear, single plane movement and are limited to isolating one muscle group while allowing other muscle groups to rest. An example of this type of exercise is the use of a curl bench, commonly referred to as a "preacher" bench. The preacher bench allows one to isolate the biceps brachii and does not require much, if any, trunk, hip, or leg activity. This type of training may be appropriate for an athlete or one who has a balanced workout regimen, but isolated, planar movement is not how the body typically moves.

The body rarely moves in just one plane and often requires multiple muscle groups to work together. Most body movement involves rotation and diagonal patterns of movement. Imagine trying to bring a fork to your mouth without any rotation of your hand or wrist. Think of taking off a sweatshirt or pulling on a pair of socks with only linear single planar movement—difficult? Yes! If we moved in single planes it would be easy to construct a mechanical hand, foot or leg to mirror human movement, but it is very difficult to replicate human movement because it is not defined through one- or two-dimensional movement. The myriad muscles surrounding our joints allow us to move in limitless but controlled patterns. With the freedom of movement in our extremities, comes a demand for stability throughout our trunk and base. For example, when we open a door we are not just pulling in a straight line with our arm. The feet are planted and as the hand-arm-shoulder complex moves, the trunk, hips and knees need to stabilize and create a base from which we can generate enough force to open the door. This stabilizing force applied to the trunk, hips and knees is not a push-pull movement, but is rather a rotational movement about the trunk. A lot of shoulder, knee, ankle and particularly back injuries occur as a result of excessive rotational force demands placed on the body.

Proprioceptive Neurofacilitation, PNF, is a school of thought within the physical therapy art that includes the assumption that the best form of rehabilitation for musculoskeletal injuries occurs in diagonal patterns through multiple planes of movement. However, this treatment technique requires a purely hands-on, manual approach, extremely demanding of therapist skill and training. The therapist presently practicing PNF must take the patient through the motions and provide appropriate resistance for the patient's need and present physical limitations. There is therefore a need in the exercise equipment art, therapeutic or not, for an apparatus that provides structured, multi-axial movement to the average healthy person or to someone recovering from back, shoulder, knee or hip injury.

While the available art provides attempts at developing portable equipment that embodies movement components of rotational and diagonal non-linear exercise, in many cases, these are smaller replicas of machines found in many fitness centers that do not address the need of simulated, non-linear, multi-axial human movement. In fact, most of the devices capture only part of the nonlinear components of movement.

One available device, illustrated in U.S. Pat. No. 4,799,475 utilizes movement that simulates crawling while the user is on hands and knees in a "quadruped" position. The device allows motion through the arc of the frontal plane and provides rotation at the hand or knee contact point. The shortcomings of this device lay in the predetermined magnitude of movement in predominantly two-dimensional patterns. The rotation of the extremities occurs at the axis point which may only affect the most distal joints of the extremities. An additional limitation is that the user has no influence over the magnitude of circular motion since the arc of movement is determined by the track on which the device moves. Resistance is only given in one aspect of the horizontal/frontal plane to adduction/abduction and extension/flexion of the extremities. The movement is controlled by the machine in which no freedom of movement in the sagittal plane occurs, thus, taking away the need for trunk stabilization. This movement is similar to that of a train on a train track that runs up and down and turns left and right. The track is moving in the vertical plane with the ups and downs and in the horizontal plane with the turns, but only a downward force is really needed to keep the train on the track. In essence the movement across any discrete segment of track is still only two dimensional.

Another device, illustrated in U.S. Pat. No. 5,279,530, attempts to exercise the lower extremity in a supine position. The disadvantages of this machine include: there is only linear movement; there is no rotational component; and it is primarily involved in single planar movement. Moreover, the most significant embodiment of this device involves exercise of only the lower extremities and only in a supine position.

In addition to the two devices mentioned, the Diagonal Rotary Patterning exercise machine featured in an article in the *Physical Therapy Forum* (vol. XIV; number 5; Mar. 10, 1995) was designed to train athletes by employing the use of rotation and diagonal movement using cables. However, the user is sitting down and the need for active trunk stabilization is not really facilitated. The rotation is supplied by a cuff that is fastened about the ankle or wrist, so the axis of rotation is within the longitudinal axis of the extremity, which makes it difficult to facilitate rotation at the proximal joint of the shoulder and hip. The movement occurs predominantly in one plane and isolates training one lower extremity at a time. This machine is large, bulky and appears particularly appropriate for for more vigorous athletic rehabilitation as opposed to the average person seeking rehabilitative, therapeutic exercise.

It would therefore be of significant value in the art to provide a device enabling a user to obtain multidimensional exercise that would allow the user to progress toward full rehabilitation by simulating the difficulty and complexity of real movement. Healthy as well as injured users could benefit from a system of devices that trains the extremities and the trunk musculature in a progressive manner, and that is position selective and, therefore, less stressful to the injured area as well as to the remaining healthy tissue.

SUMMARY OF THE INVENTION

To address the shortcomings of the available art, the present invention provides multi-planar movements, in a portable container which allows rehabilitation to begin while patients are bed-ridden. This is particularly important in acute care settings where patients cannot get out of their bed. The portability is also valuable to the versatility of the device to be used in sitting, standing, kneeling or lying in a supine position.

To address these challenges, the present invention provides a RotoBar™ device that encourages trunk muscle stabilization with dissociation at the hips and shoulders, allowing exercise to occur in a horizontal position in which there is no axial loading of the spine. A first specific embodiment facilitates rotation about the humerus, not just the forearm, via independent rotational axis pivot points that move to offset to their respective axes. This offsetting of the handles from their respective pivot points also provides additional frontal plane movement that allows the user to move in a diagonal pattern and not just a circular arc as in the available art. A second specific embodiment provides a degree of free multi-axial motion of the rotor and handles through the sagittal plane.

A more particular embodiment places the user in a "quadruped" position with either the hands or knees resting on the device. With the user in a quadruped position with the user's knees on the RotoBar device, the embodiment comprises one base device placed horizontally in which the knees via Foot/Knee/Hand or Forearm (FKHF) adapters are positioned on the handle and the user's hands are positioned on the knee pad/mat extensions. This position may be reversed with the hands on the handles of the device and the knees on the pad extensions. An added embodiment of the device used in the quadruped position comprises two base devices placed adjacent to each other with the bases attached together with snap-on couplers; the knees via knee adapters are positioned on the handle portion of one device and the user's hands are positioned on the handle portion of the other device. In another particular embodiment the user is in a supine position with feet resting on the handles of the device via a foot adapter in which the user can utilize the device with their back on the pad and fully supported while in a bridge position, the buttock elevated off the pad with only the shoulders and head in contact with the pad.

A final major embodiment of this exercise system is fulfilled in the RotoBox™ device which allows isolated unilateral or bilateral exercises specifically designed for the upper body and to be used in less vigorous positions by the patient. This embodiment's applied force is counteracted by the user through the spring loaded handle and can be utilized in a sitting, standing or lying position. This device facilitates erect posturing, trunk stabilization, and dissociation, depression, rotation, abduction/adduction and flexion/extension at the shoulder.

A first advantage of the present invention is therefore to provide an improved exercise device which obviates or mitigates at least one of the aforementioned disadvantages of available devices.

Another advantage of the present invention is the allowance of progressive adjustment from isolated exercise to a plurality of combined movements.

Still another advantage of the present invention is the portability of all devices within the system.

Yet another advantage of the present invention is that movement pattern limitations can be set by a professional therapist or the equivalent and then duplicated by the user without the professional present.

BRIEF DESCRIPTION OF THE DRAWINGS

The aforementioned advantages of the present invention as well as additional advantages thereof will be more clearly understood hereinafter as a result of a detailed description of a preferred embodiment of the invention when taken in conjunction with the following drawings in which.

DETAILED DESCRIPTION OF THE DRAWINGS

For the purpose of this discussion, certain anatomical regions and specific terminology will be defined and referred to throughout. The term "trunk" includes the multitude of bones, muscles and joints including the vertebral column from the first Thoracic vertebrae through the Sacrum, the pelvis girdle (but not the hip joint) and all muscles attaching to the joints that have no insertion sites on the humerus, scapula or the femur. The term "approximation" will represent the forces that lessen joint space and encourage co-contraction of the muscles surrounding the proximal peripheral joints, i.e., the shoulder and the hip. For this discussion "stabilization" will represent isometric contractions (muscle contraction without joint movement).

The figures illustrate the major embodiments of the present invention, the RotoBar and RotoBox systems. The function of this invention is to facilitate the user to exercise through a field of movement with multiple plane variations, thereby promoting peripheral joint dissociation from the trunk, facilitating diagonal patterns of movement, involving approximation of the involved joints, and facilitating peripheral joint rotation with concomitant trunk rotation. This device will enable the user to simulate crawling motions with adjustable variations in movement in the sagittal plane. The free movement in the sagittal and frontal planes is a major advantage of the present invention that sets it apart from the available art. Control over the stability of movement through the sagittal plane is attained in the relationship between T-tube 20 that revolves inside the T-tube base 10 and is tightened or loosened with the C-clamp and bolt 1. This allows an added degree of difficulty and variability over single planar crawling motion devices and closely represents human body movement in space. This sagittal movement translates into rotational forces in the transverse plane of the trunk. Weak and poor ability to co-contract and stabilize the trunk muscles have been identified in orthopedic and physical therapy fields as a major precipitating factor in back injuries.

Figure 1:
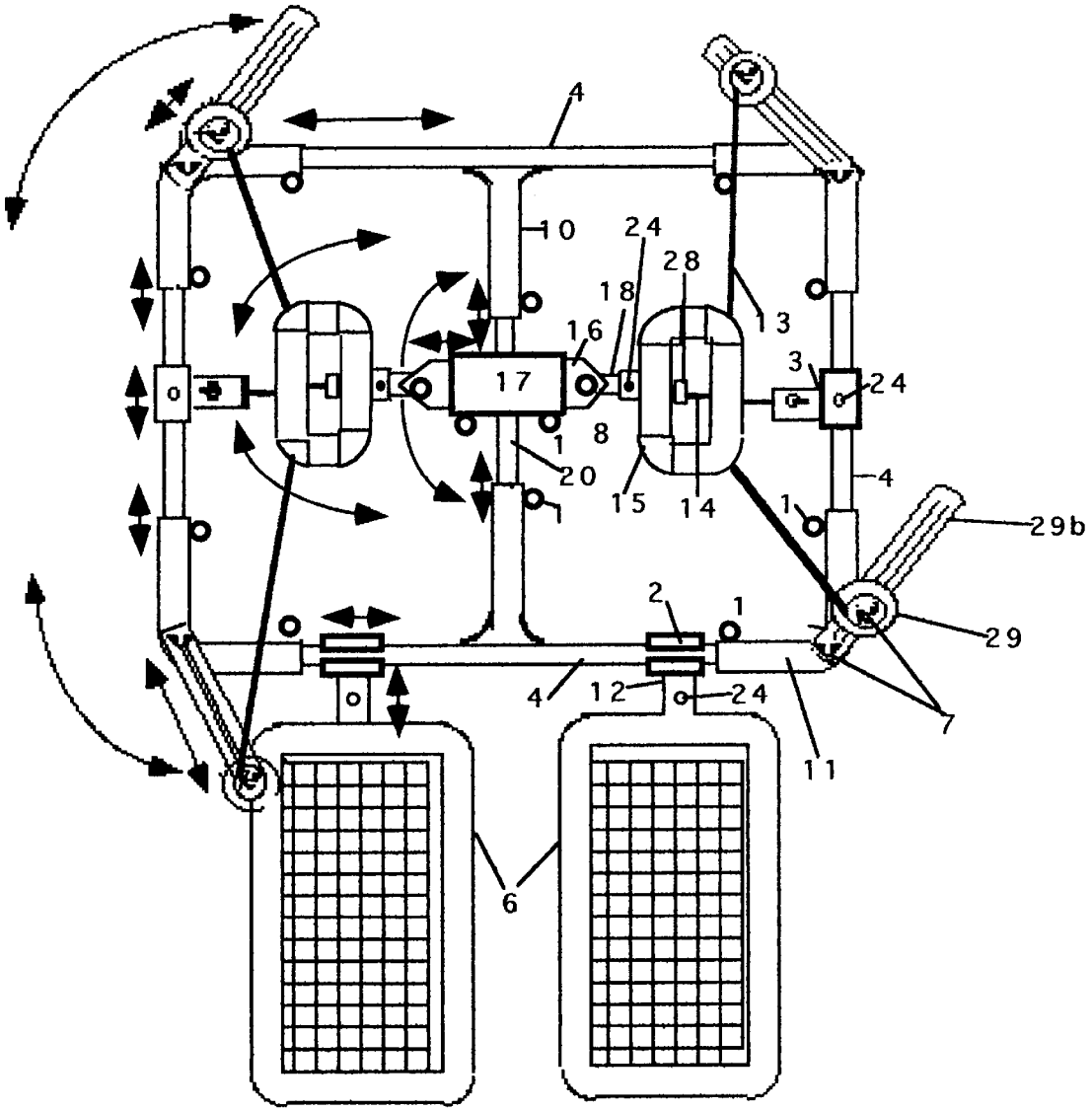
FIG. 1 is a perspective view of one of the embodiments of the RotoBar device in the horizontal plane.
Figure 2:
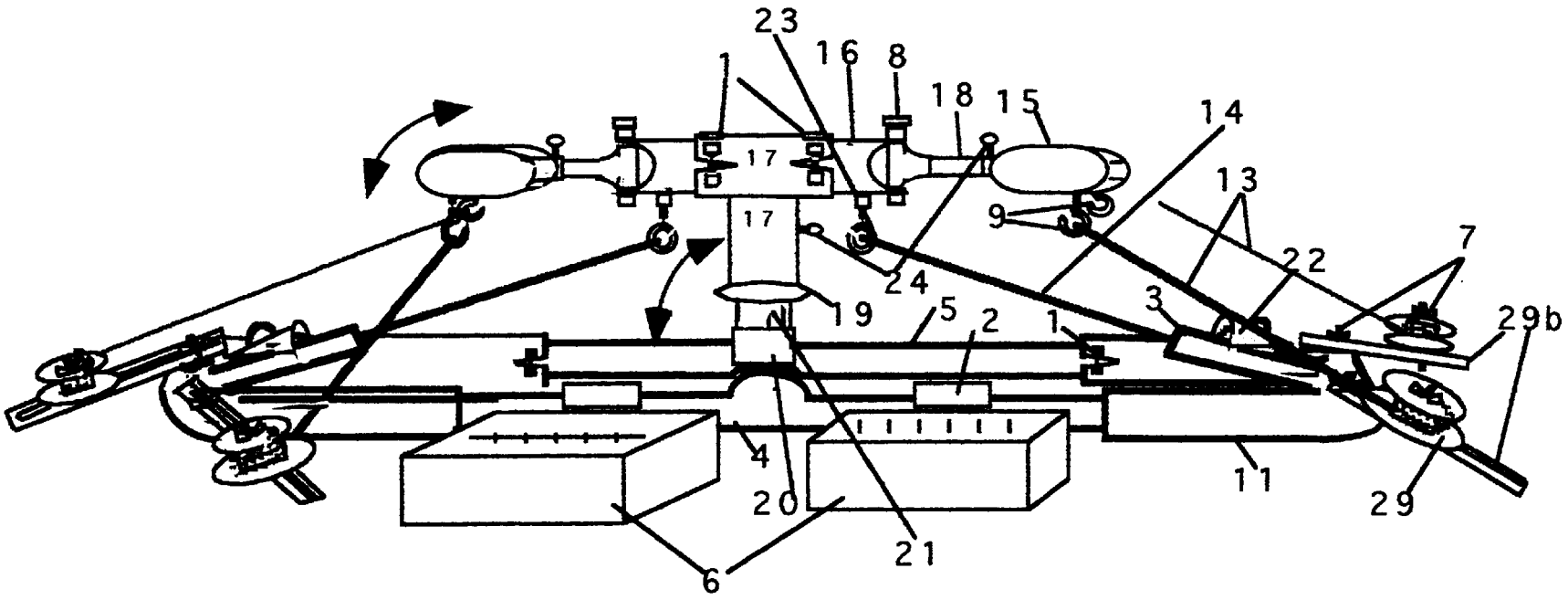
FIG. 2 is a perspective view of the RotoBar device in the vertical plane.
Figure 2A:
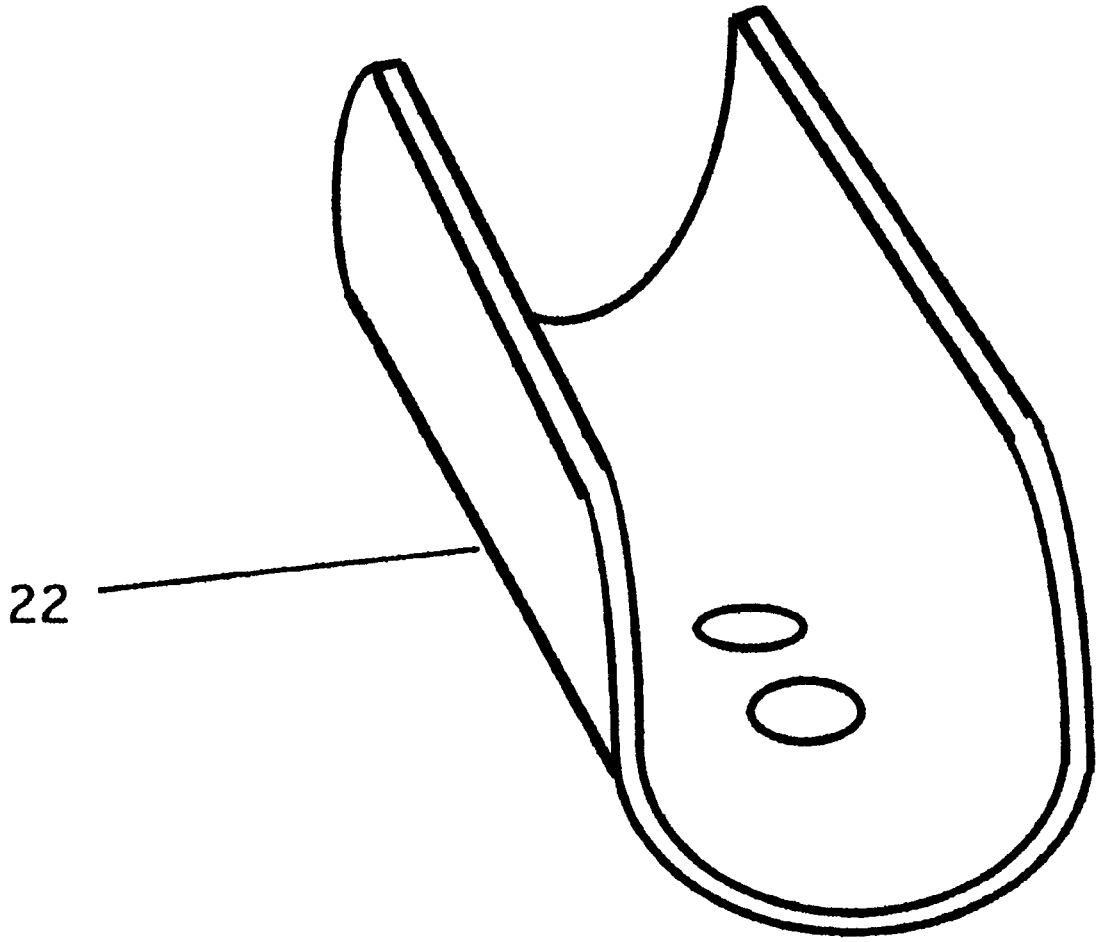
FIG. 2*a* is a perspective view a an anchor mechanism for securing an elastic means of resistance.
Figure 2B:
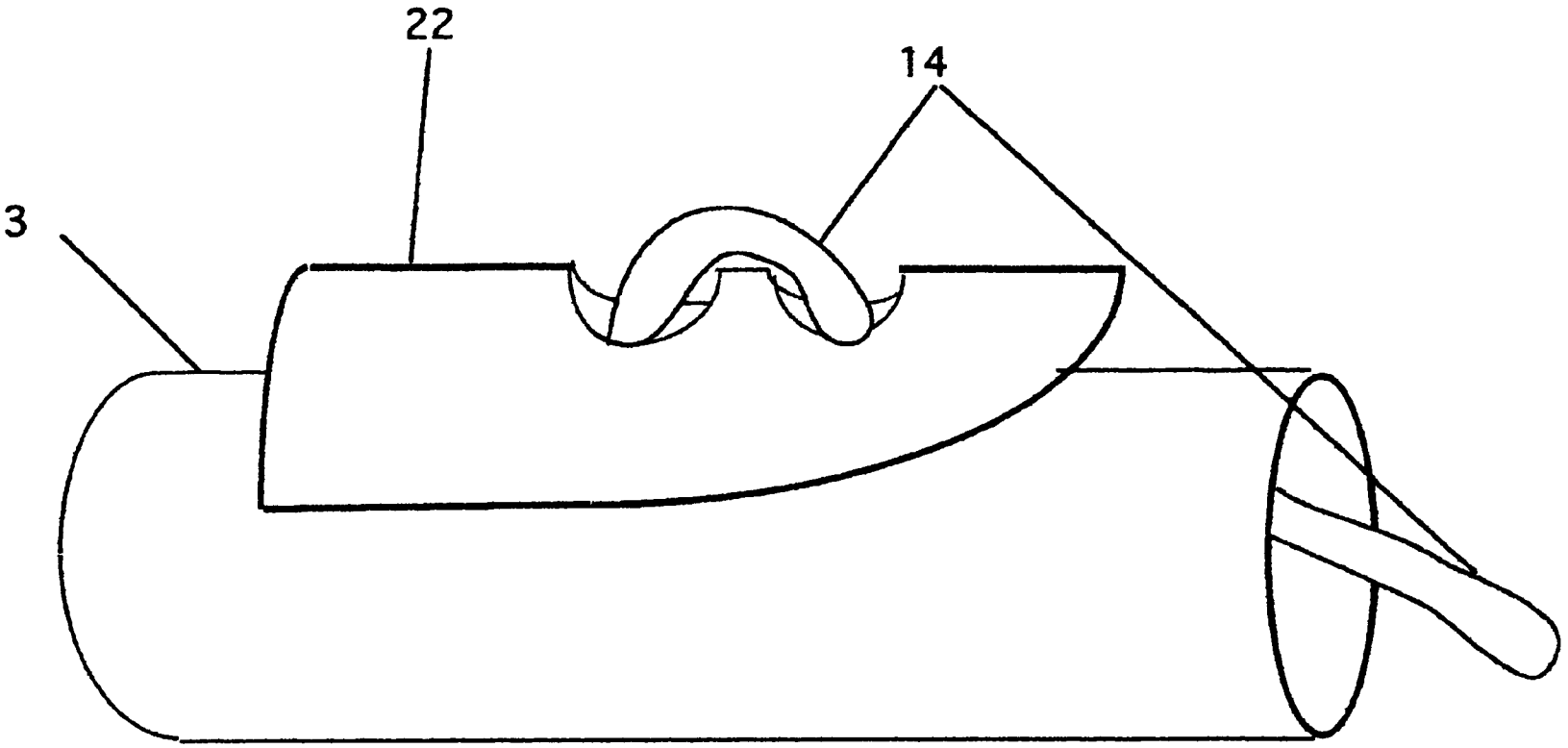
Figure 17:
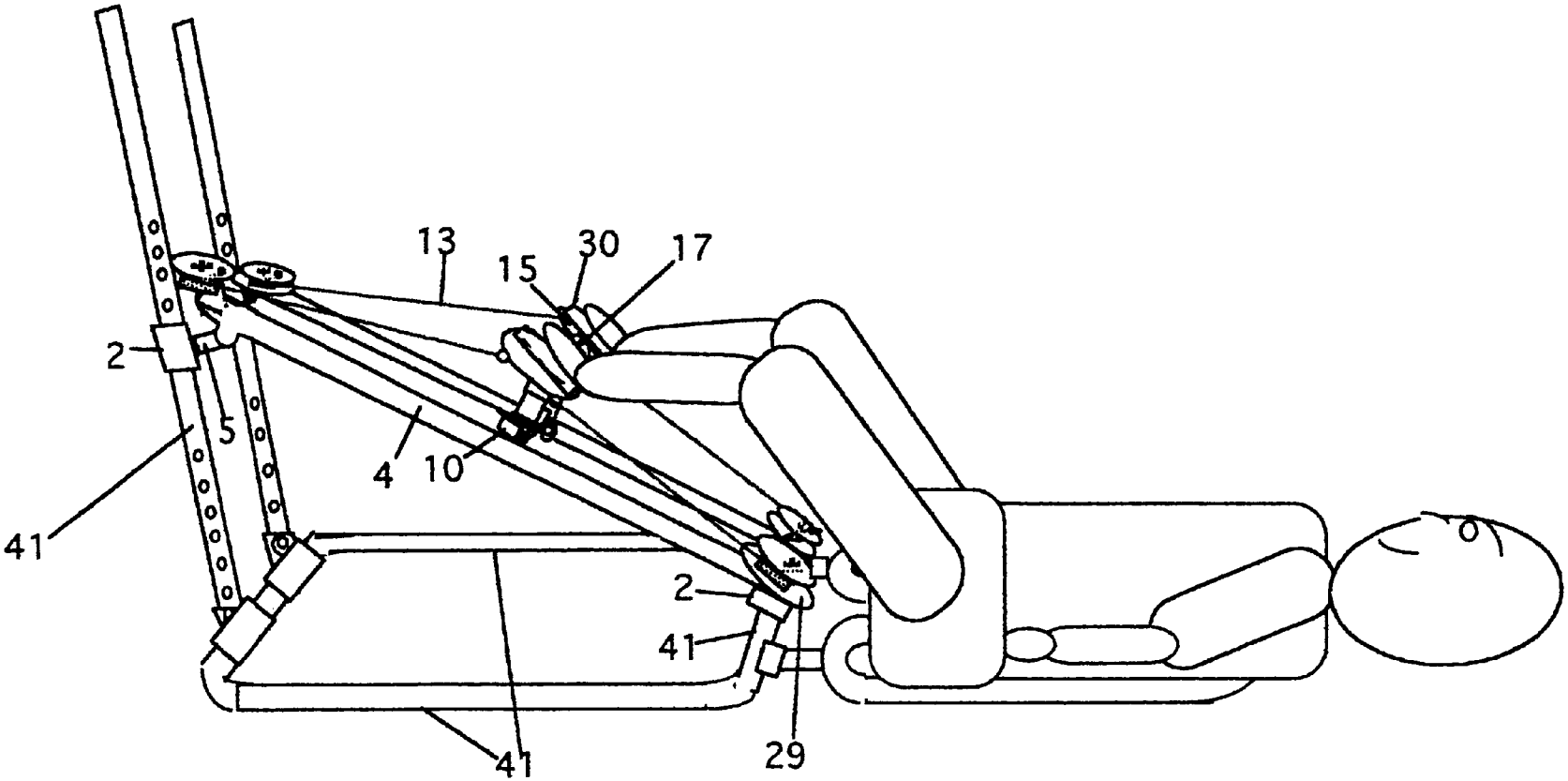
FIG. 17 illustrates a user demonstrating an embodiment of the RotoBar device in a supine position with use of the lower extremities with the base at an angle supported by an adjustable angle stand 41.
Figure 17A:
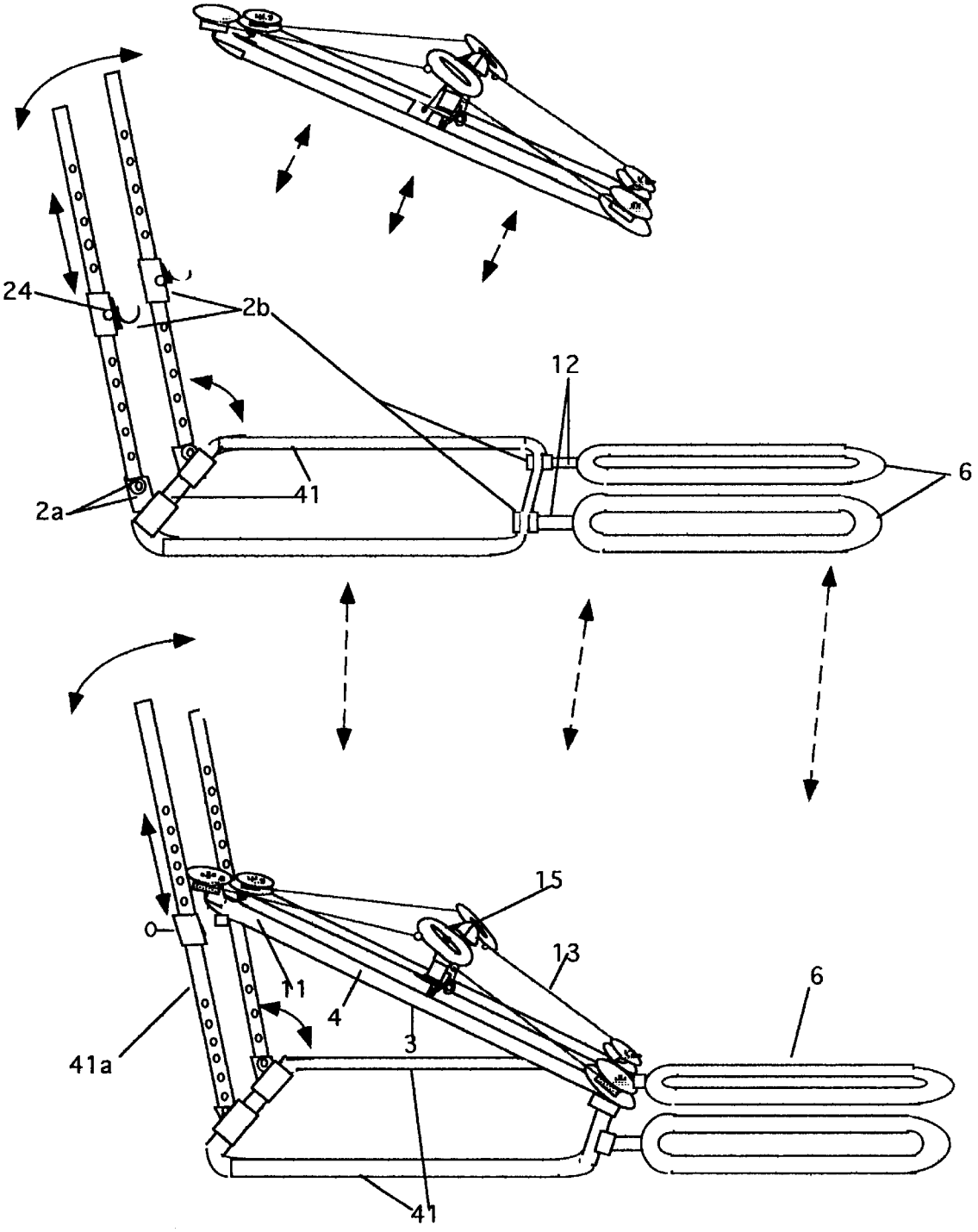
FIG. 17*a* is a perspective view of the RotoBar device in conjunction with the adjustable angle stand 41.
Figure 17B:
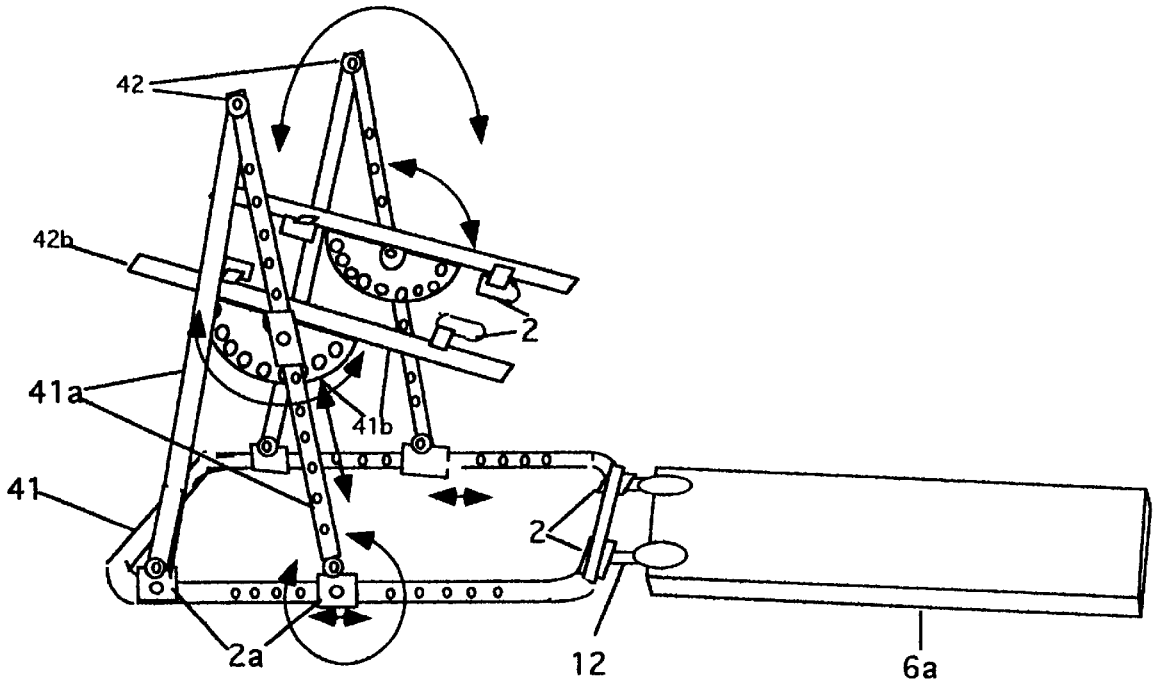
FIG. 17*b* is a perspective view of the RotoBar device in conjunction with the combination adjustable angle stand 42.
Figure 17B:
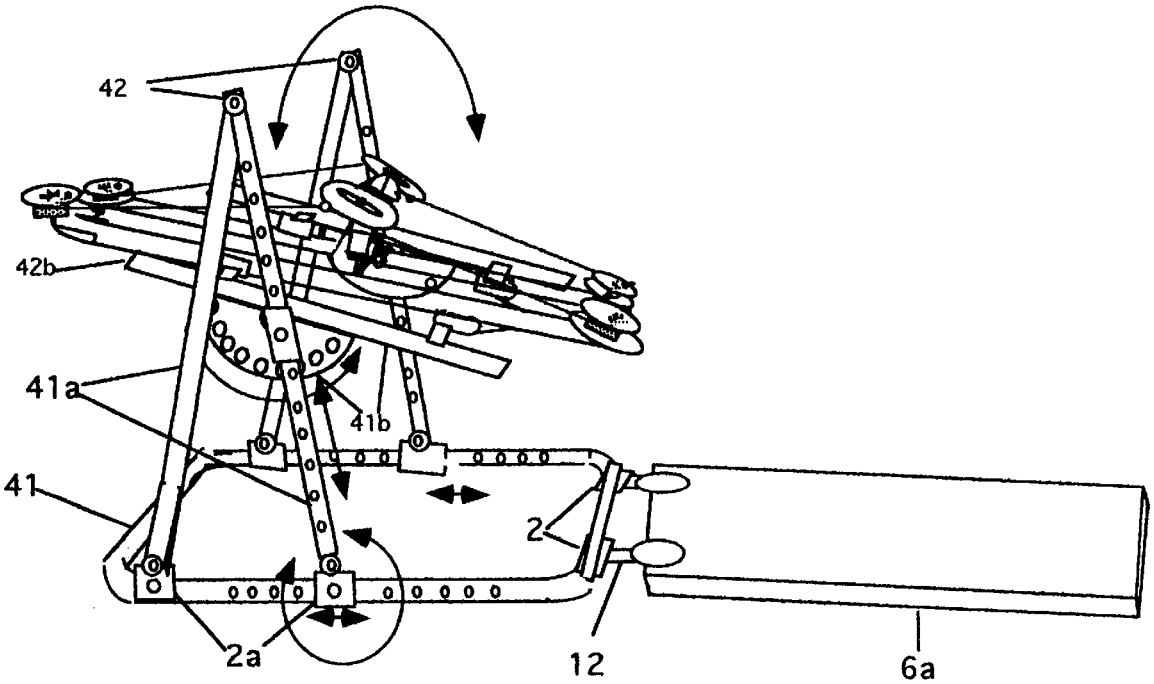

As illustrated in FIG. 1, the foundation of the unit is the base comprising: base extension tubes 4 and 5, the T-tube 10 and corner coupler 11 with knee pads 6 or (FIG. 17*b*) mat 6*a* attached via coupler extensions 12 and segment 2, as shown in FIG. 17*b*. The embodiment of the base shown in FIG. 1 is rectangular, but this shape and size is adjustable to accommodate different sizes of users by changing width and length through adjustments within the components of the base via changing the relative position of the corner couplers 11 to the relative position of the extension tubes 5 and 4 and secured with C-clamp and bolt 1. The coupler extension 12 and segment 2 are means of attachment/connection of the base to the knee pads 6 or the mat 6*a* or to an additional 4, 5, and 11 base. FIGS. 17*a* and 17*b* illustrate the variability of potential uses of the RotoBar invention through the option of the single angle stand 41 and the combination angle stand 41. The angle adjustments on the single angle stand are adjustable through sliding joint brackets 2*a* in which the risers 41*a* pivot at hinge joints 42. On the combination angle stand 41 the risers 41*a* act as vertical stays for the multiple angle carriage brackets 42*b* to slide on. The use of these stands with the device open up numerous possibilities for exercise in the sitting, standing or supine positions and would allow for variability to accommodate possible work simulation with multivariant angular movement patterns.

The resistance applied to both rotation of the extremities 13 and 29 and adduction of the extremities 14 and 3 in the frontal plane is fully adjustable to accommodate to the users therapeutic needs (this includes angle of pull via adjustable pulley/spools 29 on the pulley carriage 29B and the adductor tubes 3). The amount of resistance to rotation or adduction can be obtained through tightening of the tension spool 29 which is locked in place with a wing nut 7 and adductor tube 3 or changing the means of resistance 13 and/or 14 or when attached to a pulley system, by adding additional weight. A key feature of the resistance is that the adductor tube 3 controls for quantity of means of resistance and the angle of pull to rotor 17 which directly controls for adduction/abduction and extension/flexion; this angle can be changed via sliding the adductor tube 3 over base extension tube 4 which is held in position by a locking screw 24. The tension on the resistance means 14 is secured on the adductor tube 3 through the tension clips 22. The quantity and angle of pull of resistance to the handles (means of extremity rotation), can be changed independent of adduction/abduction and flexion/extension via sliding adjustment of the pulley/spools 29 on the pulley carriage 29B and/or through tightening of the tension spool 29 or changing the means of resistance 13 or when attached to a pulley system, by adding additional weight. The angle of pull, thus the maximum point of resistance in any given point in the arc of movement, can be further adjusted with the movement of the spool carriage 29*b* and held fixed in place through tightening of wing nut 7. The absence of resistance imposes no fundamental changes in movement and allows greater variability in exercise. This device, in its portable embodiment, can also be utilized in the vertical position mounted to a wall with no fundamental changes in movement.

Figure 3:
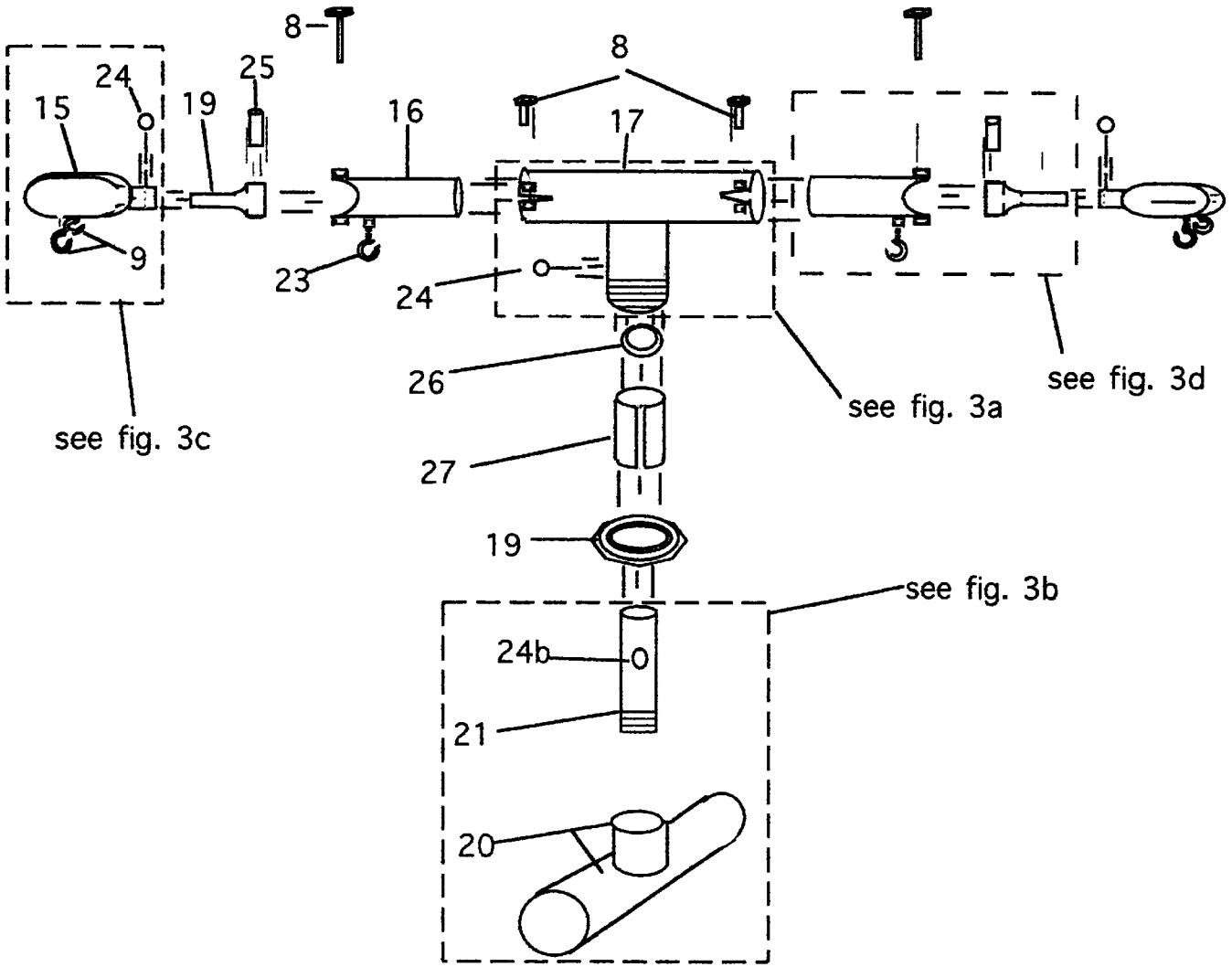
FIG. 3 is an exploded view of the rotary components of the RotoBar device in the vertical plane.

The rotary portion of the device is also adjustable to accommodate different size users. FIG. 3 provides an exploded perspective view of the rotary parts of the inventive device and illustrates the rotor arm 16 which provides adjustment for the width between the handles 15 by moving in and out in relation to rotor 17 and secured in position by C-clamp and bolt 1.

Figure 5:
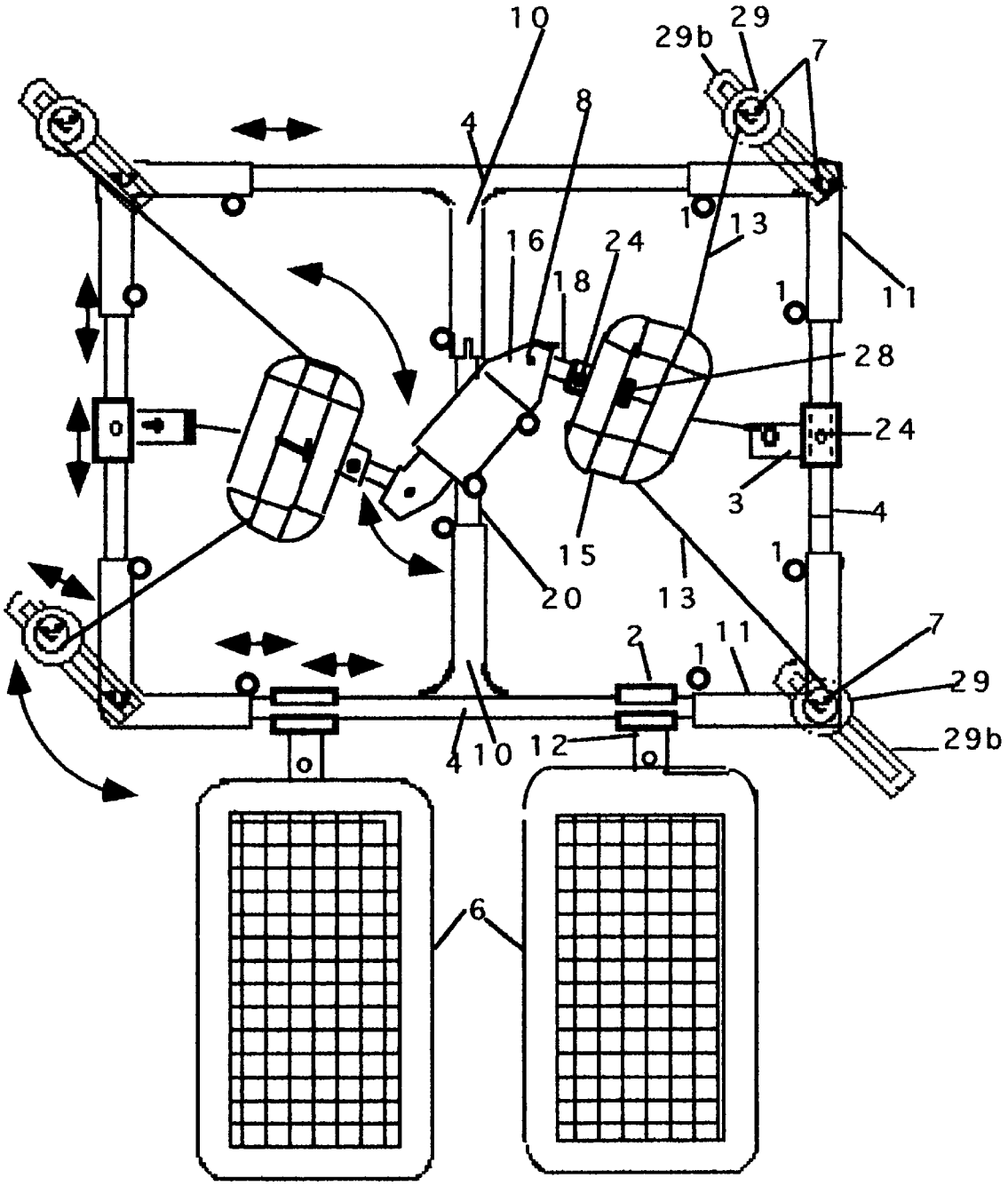
FIG. 5 is a perspective view of two of the rotational embodiments of the rotor and handle of the RotoBar device with a perspective of the resistance means.
Figure 6:
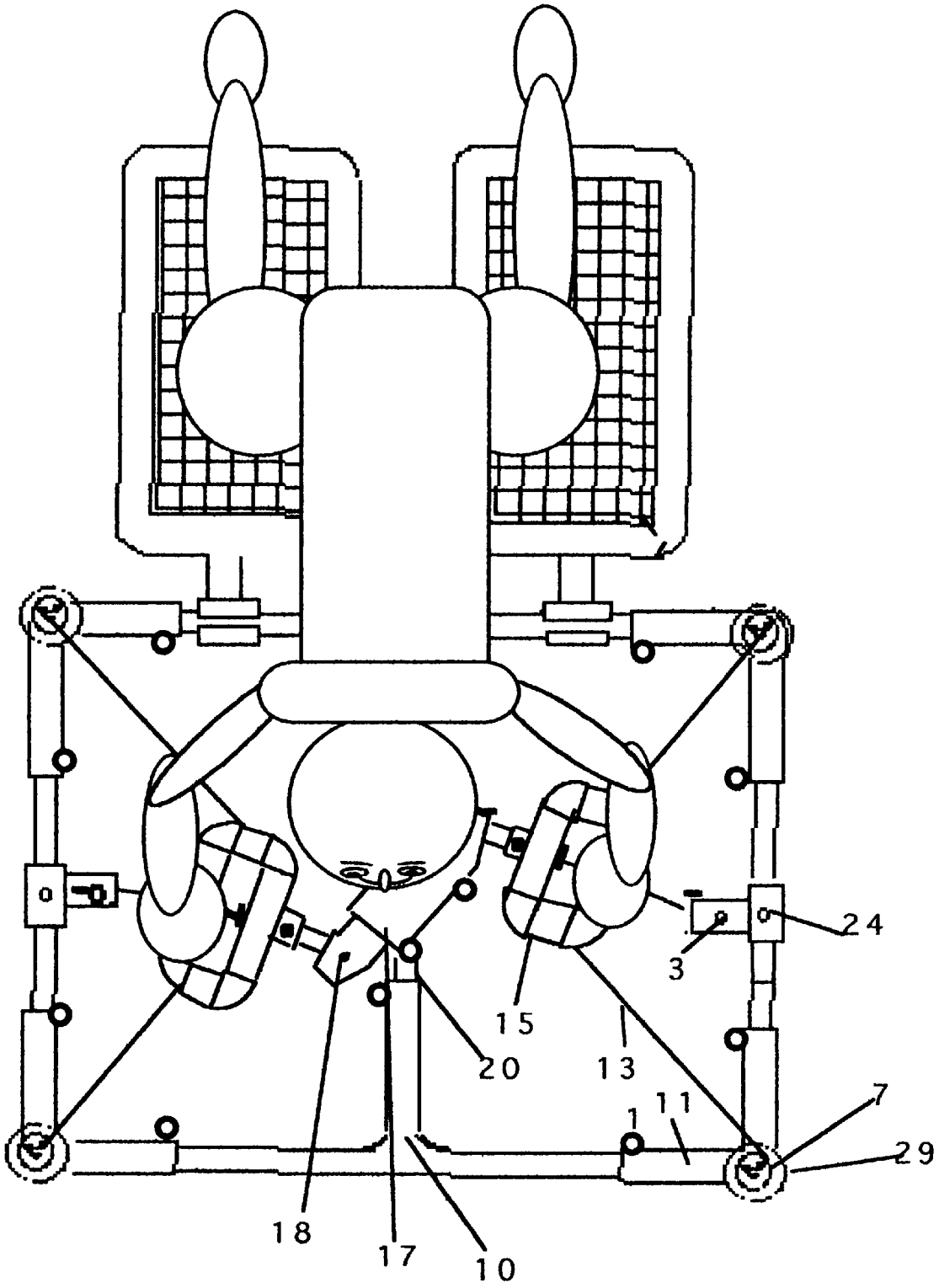
FIG. 6 illustrates a user demonstrating the rotational components of the RotoBar device embodied in FIG. 5.
Figure 7:
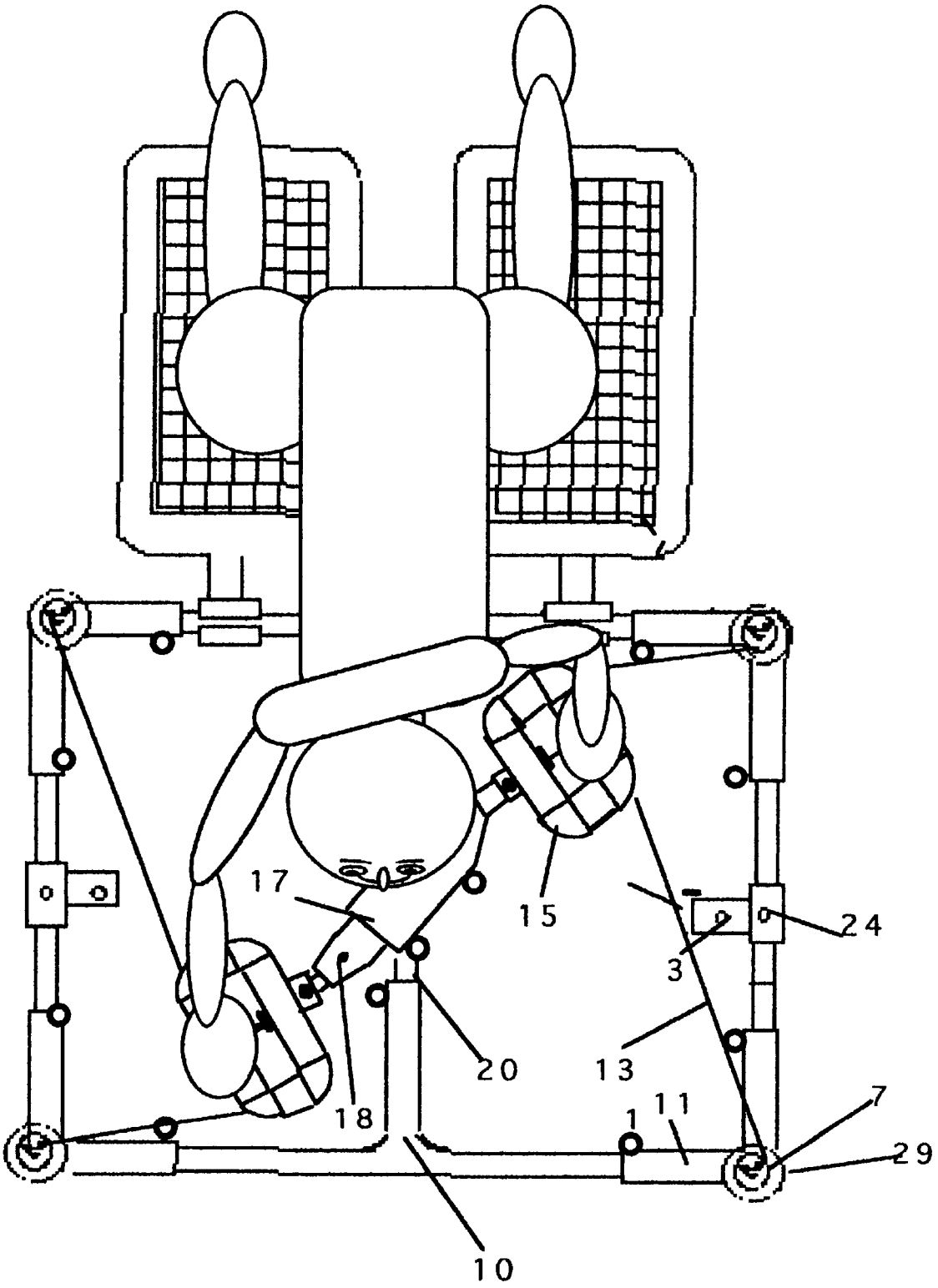
FIG. 7 illustrates a user demonstrating adduction while resisting internal or external rotation about the satellite axis points 8.

FIG. 5 is a perspective view of an embodiment of the invention and illustrates movement in the frontal plane. FIGS. 1 and 5 illustrate the scope of movement of the rotor 17, the handles 15 and the handle pivot bar 18 about their respective axis points 8 in the frontal plane. FIGS. 1 and 5 provide a perspective view of the resistance means 13 and 14 that provide the resistance to 15 and 17 respectively. The resistance attaches to the handle 15 via 9 and to the rotor arm 16 via eye loops 23. FIGS. 6 and 7 illustrate two additional types of rotational movements of the rotor 17 and the handles 15. The difference in rotation in this devices from the available art is exemplified in the pivot bar 18 which displaces the handle 15 from the center of the axis point 8. Having the handle displaced off the center of the axis point 8 allows for the unique rotation embodied in this device. The handles could be of fixed type or adjustable to change to distance of the user's hand or feet in relation to the satellite axis points 8. The handle 15 is off-set from axis of rotation 8 by the pivot bar 18 which promotes rotation to occur at the proximal joint of the shoulder and not promote rotation through the forearm. Rotation about the humerus is achieved by turning the handle 15 about the satellite axis points 8. This motion elicits internal and external rotation of the humerus at the glenohumeral fossa (shoulder).

A greater form of rotary isolation about the satellite axis points would be to fix the rotor complex about its central axis. This isolation is achieved through insertion of locking pin 24 into rotor and locks rotor on riser 21 by inserting locking pin 24 through rotor 17 and in to locking pin receptor 24*b* located on riser 21. A further isolation of rotation at the glenohumeral joint is achieved through use of the forearm adapter 30*c* shown in FIG. 4*a*. This action with weight bearing through the upper extremities isolates the rotator cuff in dynamic eccentric and concentric contractions while requiring the serratus anterior muscles and the rhomboid muscles to work as a force couple to hold the scapula in a stable isometric position. A stable scapula allows for proper glenohumeral rhythm and protects the shoulder joint from injury. Weight bearing through the upper extremities requires full recruitment of the myotatic unit about the glenohumeral joint and may help facilitate proper muscle reeducation. It is often forgot that in order to get full glenohumeral motion one needs humeral head depression which is a result of the force couple produced by the internal and external rotators of the shoulder which is facilitated through approximation and weight bearing. The present invention requires that the internal and external rotators work together to depress the humeral head during shoulder joint motion. This is also the premise behind the RotoBox shown in FIGS. 12–15 which sets it apart from available art by having a resisted load along the long axis of the humerus via the sprig loaded riser/coupler 33.

Figure 10:
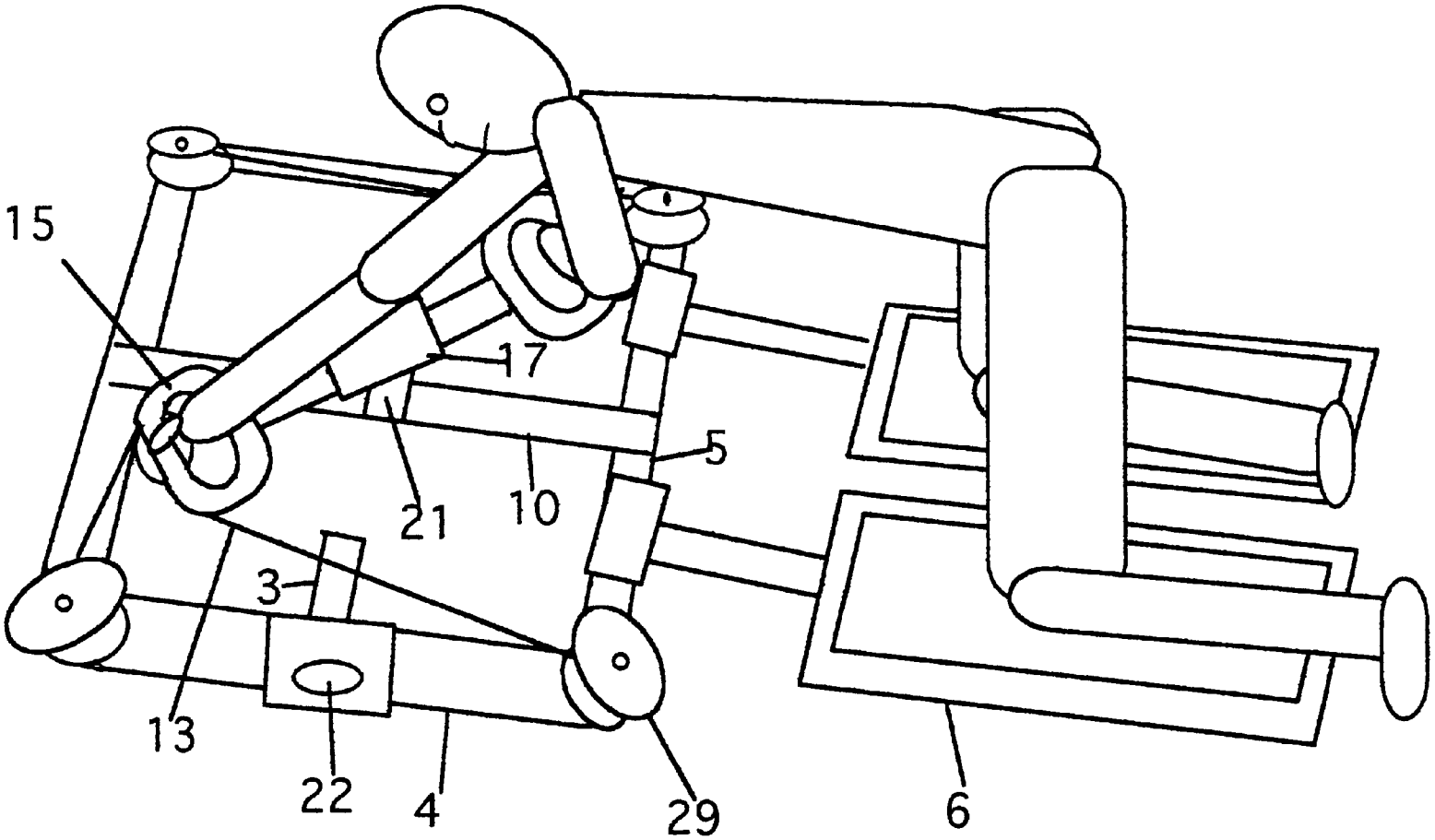
FIG. 10 illustrates a user demonstrating the use of the RotoBar device in a quadruped position with the arms starting in a crossed position.

An additional embodiment allows the user to work on scapular stabilization and horizontal extension of the shoulders by crossing hands and placing the right hand on the left handle and the left hand on the right handle. This method of use of this invention is shown in FIG. 10, wherein the thumb of the right hand is pointing towards the user's body and the thumb of the left hand is pointing away from the user's body. This exercise works the rhomboid muscles and the posterior deltoid muscles and requires cocontraction of the serratus anterior muscles. The user may reverse the hand positions to achieve the same effect on the other shoulder.

Figure 11:
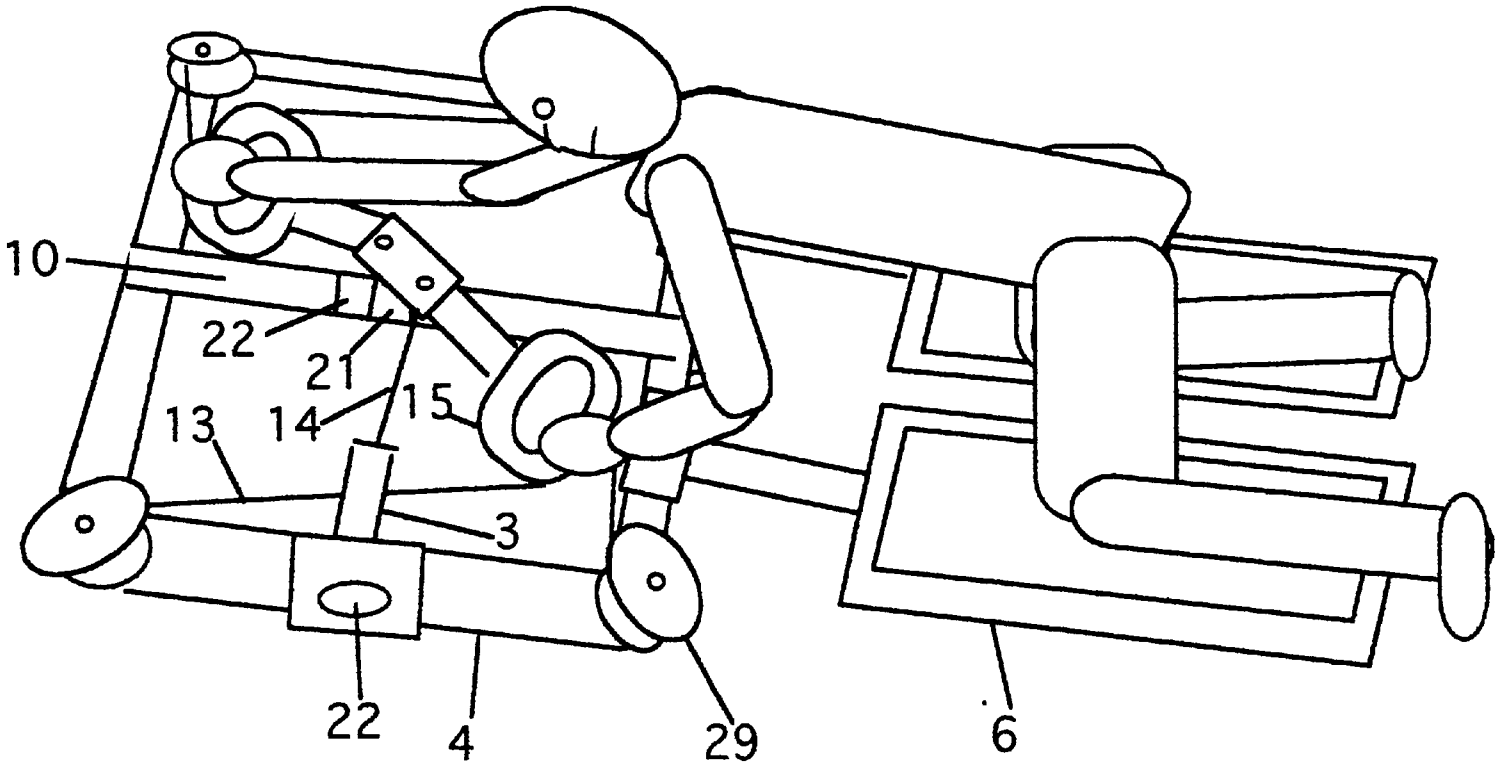
FIG. 11 illustrates a user demonstrating an embodiment of the RotoBar device that involves an over-head pushing motion of the user's right side and a reciprocal pulling motion of the user's left side.

FIG. 11 displays a picture of a user demonstrating an embodiment of the device that strengthens the deltoid muscles and lower trapezius muscle of one shoulder by providing a pushing action above the head (see right arm in FIG. 11), and the rhomboid muscles and latissimus dorsi muscle of the other shoulder with a pulling action down toward the waist (see left arm in FIG. 11). A perpendicular grip attachment could be fastened to the handle for ease of use.

Figure 3A:
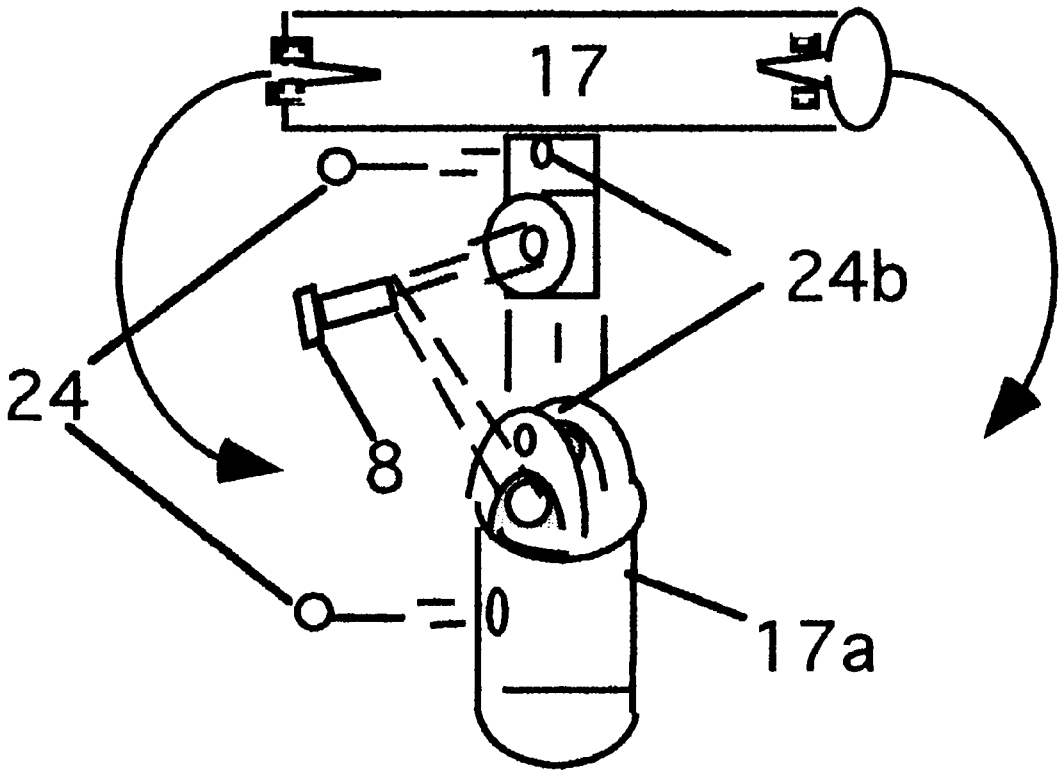
FIG. 3*a* is an exploded view an axle joint option for the rotary component of the RotoBar device.
Figure 3B:
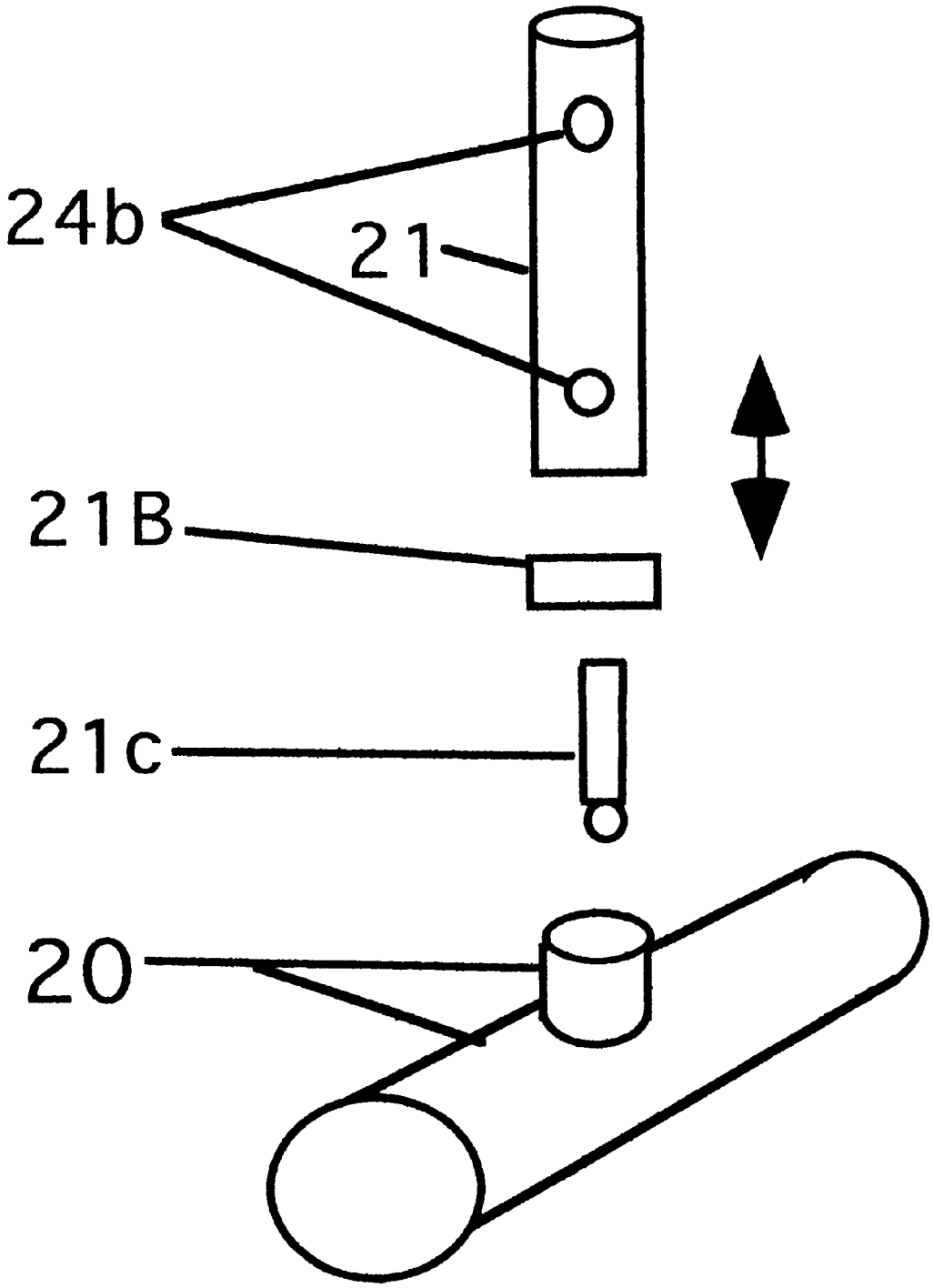
FIG. 3*b* is an exploded view of a multi-axial 'ball n' socket joint option for the riser component of the RotoBar.
Figure 3C:
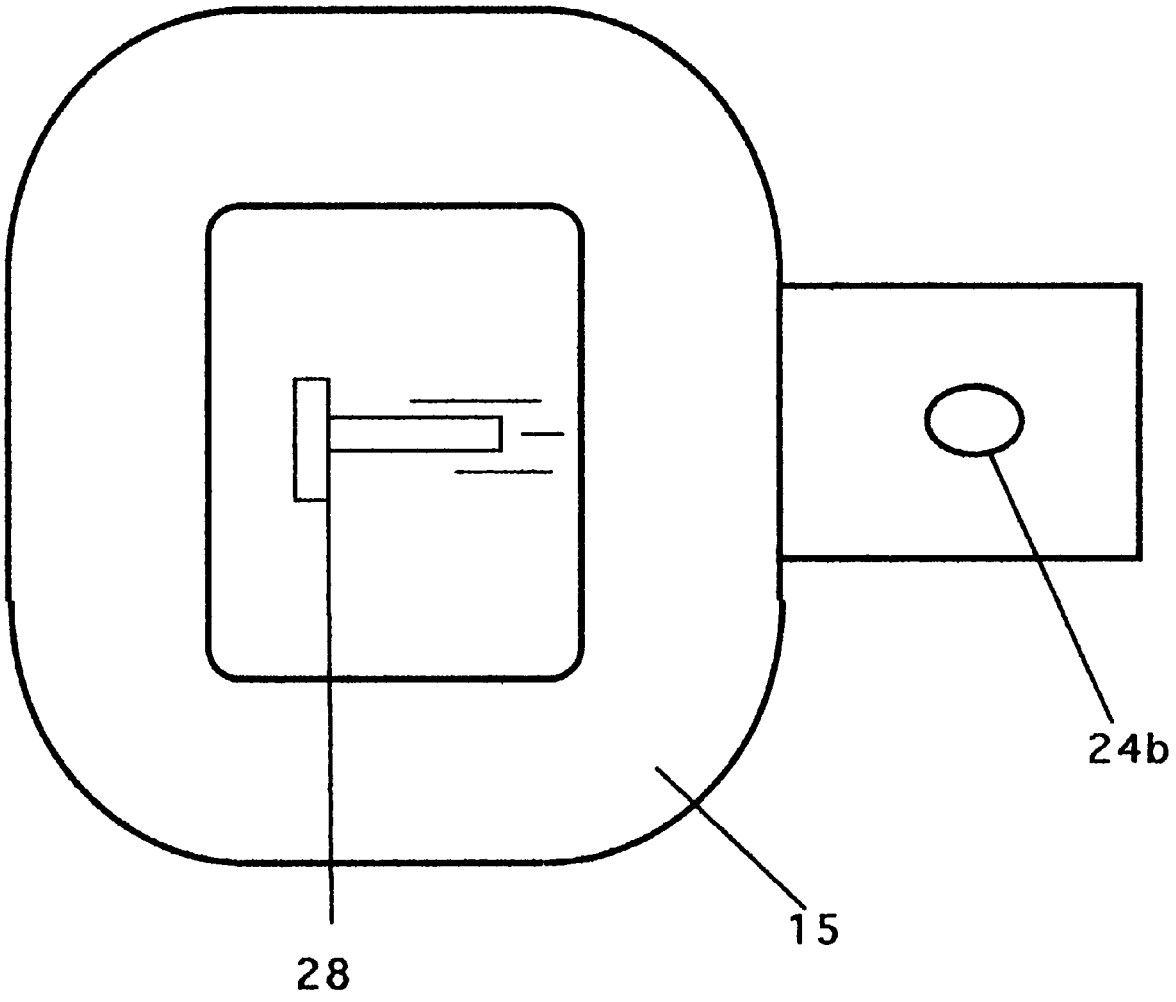
FIG. 3*c* is an exploded top view of the handle system of the invention.

An additional feature of the present invention that is not found in the available art is that the handle 15 rotates about the longitudinal axis of the pivot bar 18 in the transverse plane of the pivot bar 18. This accommodates natural ulnar and radial deviation at the wrist which occurs when the hand is in a relatively fixed position and the distal portion of the extremity moves relative to the proximal portion of the extremity. The movement of handle 15 about the pivot bar 18 is controlled by a locking pin or screw 24. FIG. 3*c* illustrates the handle complex which contains the screw 28 which secures the handle 15 to the pivot bar 18, yet allows for rotation to occur.

FIG. 6 illustrates a user performing bilateral, combined shoulder movements with the right shoulder in flexion/adduction and a neutral rotational position but resisting forces of external rotation with an isometric contraction for rotation and a isotonic contraction for flexion and adduction. Concomitantly, the user's left upper extremity is moving toward extension/adduction and a neutral rotational position but resisting forces for internal rotation with an isometric contraction of rotation and a isotonic contraction for extension and adduction. The serratus anterior muscles as well and the shoulder girdle and trunk muscles are involved in stabilizing the scapula to allow for proper glenohumeral dissociation. The rotor complex (15, 16, 17, 18) rotates about the riser 21 via the bearing 26, the slip-tube bushing 27 which is secured by a locking nut or C-clamp 19. The multiple axes of movement allowed with the invention control for variability in all planes and require the user to hold the rotor complex (15–18) level. The discrete embodiment of the device illustrated in this figure is intended to prevent sagittal movement of the upper extremities relative to the trunk, and is controlled by the rotation of the T-tube 20 in the T-tube base 10. This device can adjust for the level of difficulty in maintaining the rotor complex (15–18) level in the frontal plane parallel to the base. The C-clamp 1 could be tightened to increase resistance to movement about the T-tube 20, thereby creating a more stable rotor complex 15–18 in the sagittal plane, thus requiring less trunk and shoulder muscular control from the user to maintain the rotor complex in the frontal plane parallel to the base.

This invention does not operate on a track and further distinguishes itself from the available art by providing a structure for at least one movement pattern, but not limiting the user to only one pattern. An example is illustrated in the embodiment of the invention shown in FIG. 7 in which the same trunk involvement and requirement for shoulder stabilization and dissociation as in FIG. 6 is disclosed, but exerts different rotational forces on the extremities. Altering rotational forces throughout movement is an excellent way of strengthening the body in a variety of positions since normal, uninhibited bodily movement does not occur in the same plane and the same position time after time.

The present invention used in any position (standing, kneeling, quadruped and with the lower extremities) entails reciprocal bilateral asymmetrical and symmetrical extremity movement in the opposite extremity. As illustrated in the perspective view of FIG. 7, the user's right arm/shoulder complex moves into flexion/adduction/internal rotation and the left arm/shoulder complex moves into extension/adduction/external rotation. This bilateral asymmetrical movement encourages active and passive trunk bending, the significance of which is further explained below.

Figure 9:
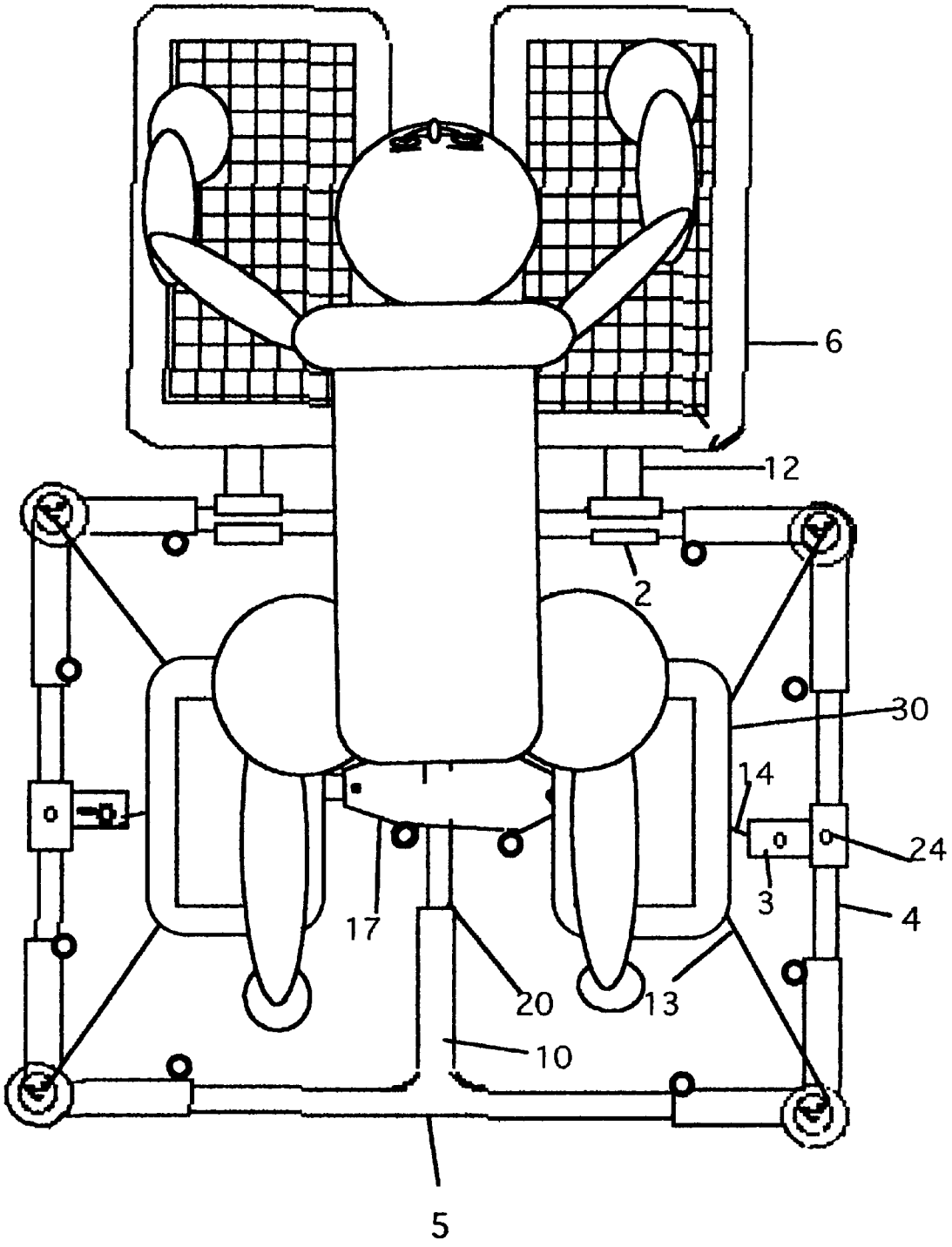
FIG. 9 illustrates a user demonstrating the use of the RotoBar device in a quadruped position with the knees resting on the handle 15 portion of the device via knee adapters 30*b*.

An embodiment that provides similar movement for the upper body is demonstrated for the lower extremities in FIG. 9. The user's knees are placed on the foot/knee adapters 30 shown in FIG. 4 and attached to the handles 15 via foot/knee fastener 32. All of the aforementioned embodiments with the upper extremity can be performed with the lower extremities as demonstrated in FIG. 9. For users with neurological impairments foot/knee fastener 32 could be modified and shaped for hands and then attached to the handles. This would allow those patients that do not have control of their hands could still benefit from the use of this machine.

Figure 4:
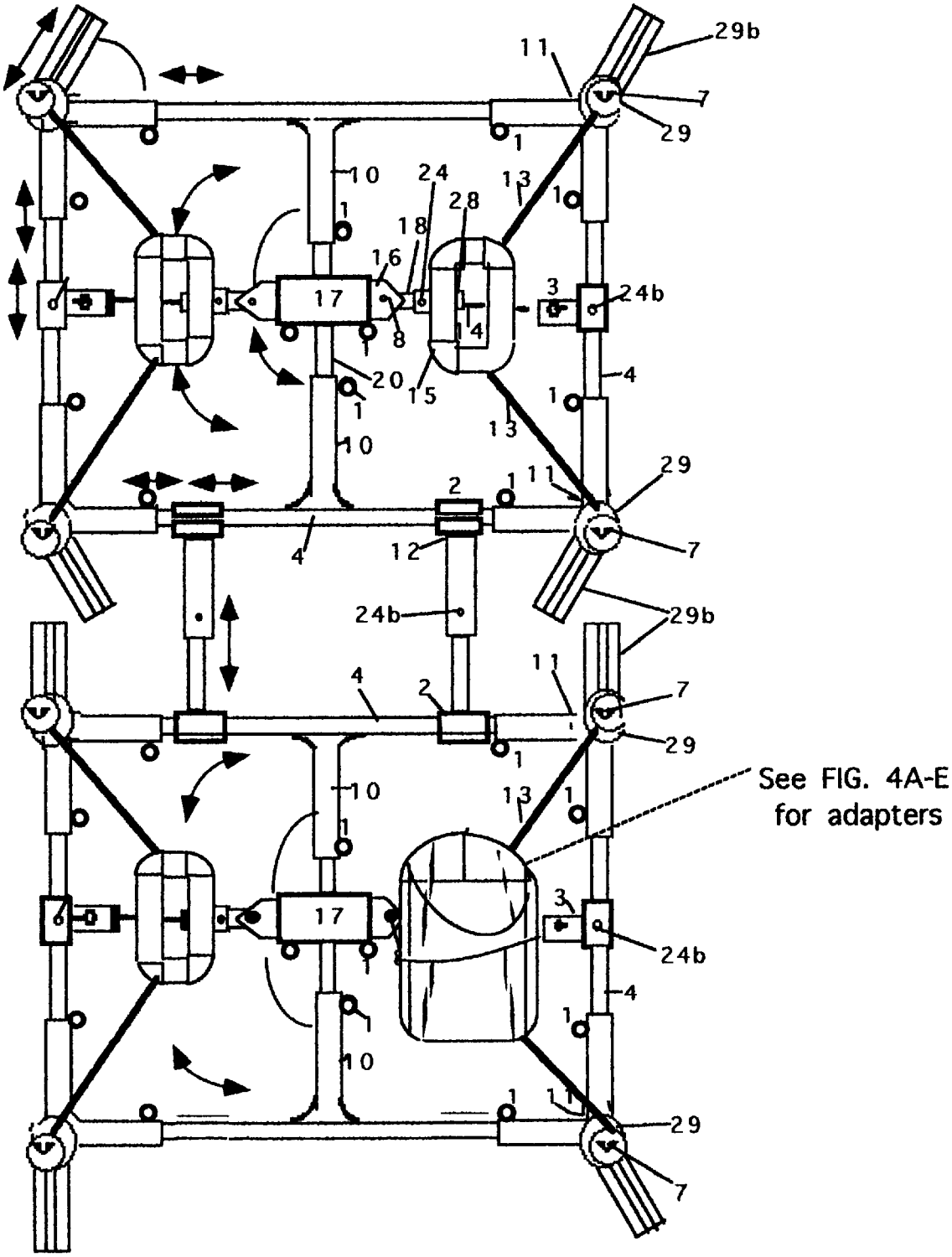
FIG. 4 is a perspective view with two of the RotoBar devices and the foot adapter for this invention.
Figure 4A:
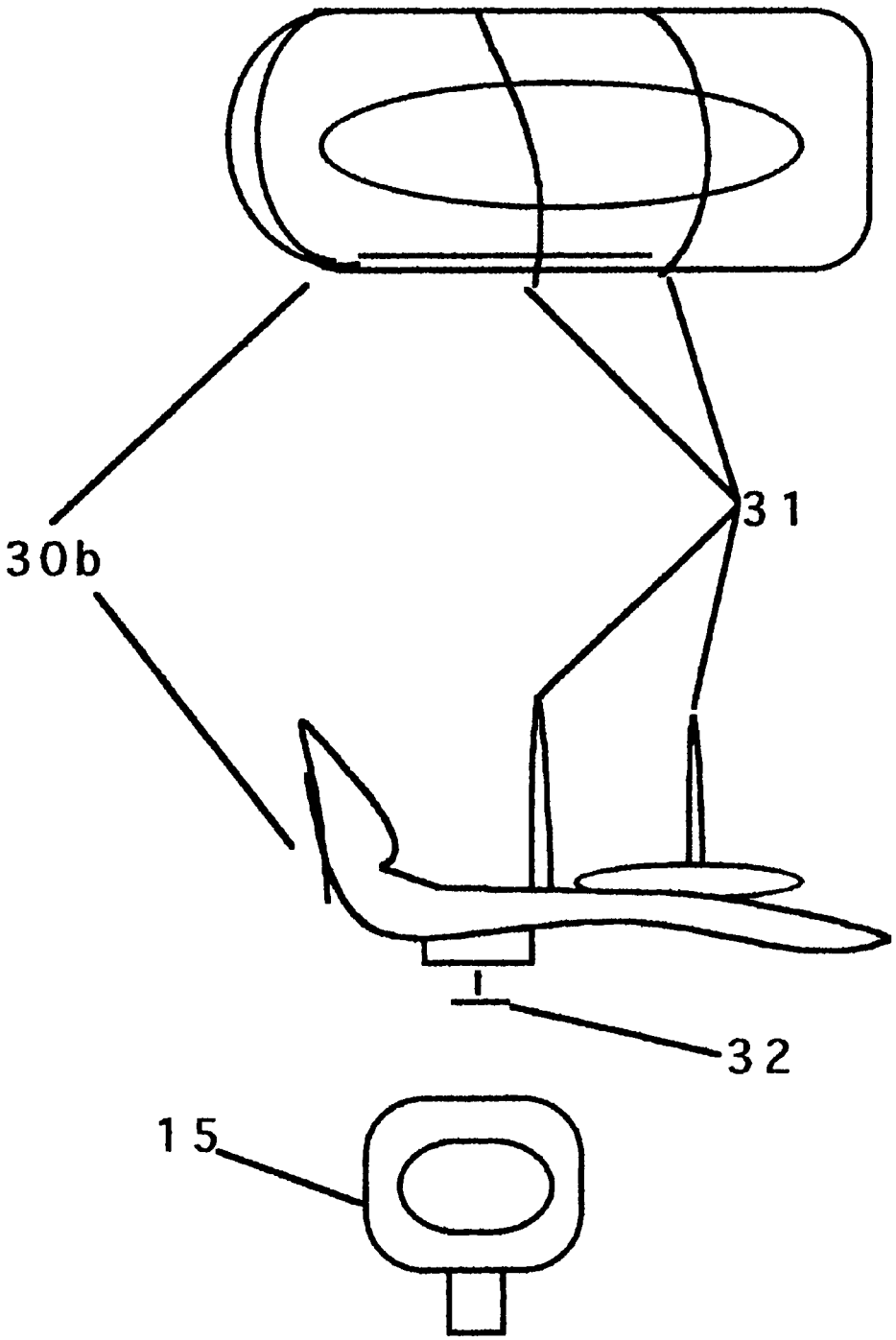
FIG. 4*a* is a perspective view of the handle adapters for this invention.

A further embodiment of the present invention for use in a quadruped position is to place two devices next to each other and attach them with C-coupler extensions 12 and 2 as illustrated in FIG. 4. One device would support the knees or feet via the knee adapters 30*b* or feet adapters 30, and the hands would be supported throughout the handles 15 or via the forearm adapters 30*c* or hand adapters 30*a* on the other device. While this method of use of the present invention provides the least stable environment for exercise and requires tremendous control of all muscles surrounding the trunk, shoulders and hips, this method allows for the greatest degree of active and passive trunk side bending. A user utilizes the exercise means in a quadruped position with the user's hands grasping the handles and moving the user's upper extremities in reciprocal patterns of at least one combination of, shoulder flexion/extension and further comprising but not limited to shoulder rotation, shoulder abduction/adduction scapular protraction/retraction, trunk flexion/extension and trunk rotation. With the use of two devices secured to each other, similar movement patterns would occur in the lower extremities as well.

Passive trunk lengthening is used in physical therapy as effective mode for pain relief with certain back ailments and provides and indirect method to achieve movement and trunk musculature stretching. With the right upper extremity moving into extension/adduction and the right lower extremity moving into flexion/adduction, active shortening of the right side of the trunk and passive left sided trunk lengthening occurs (see FIG. 7).

Figure 8:
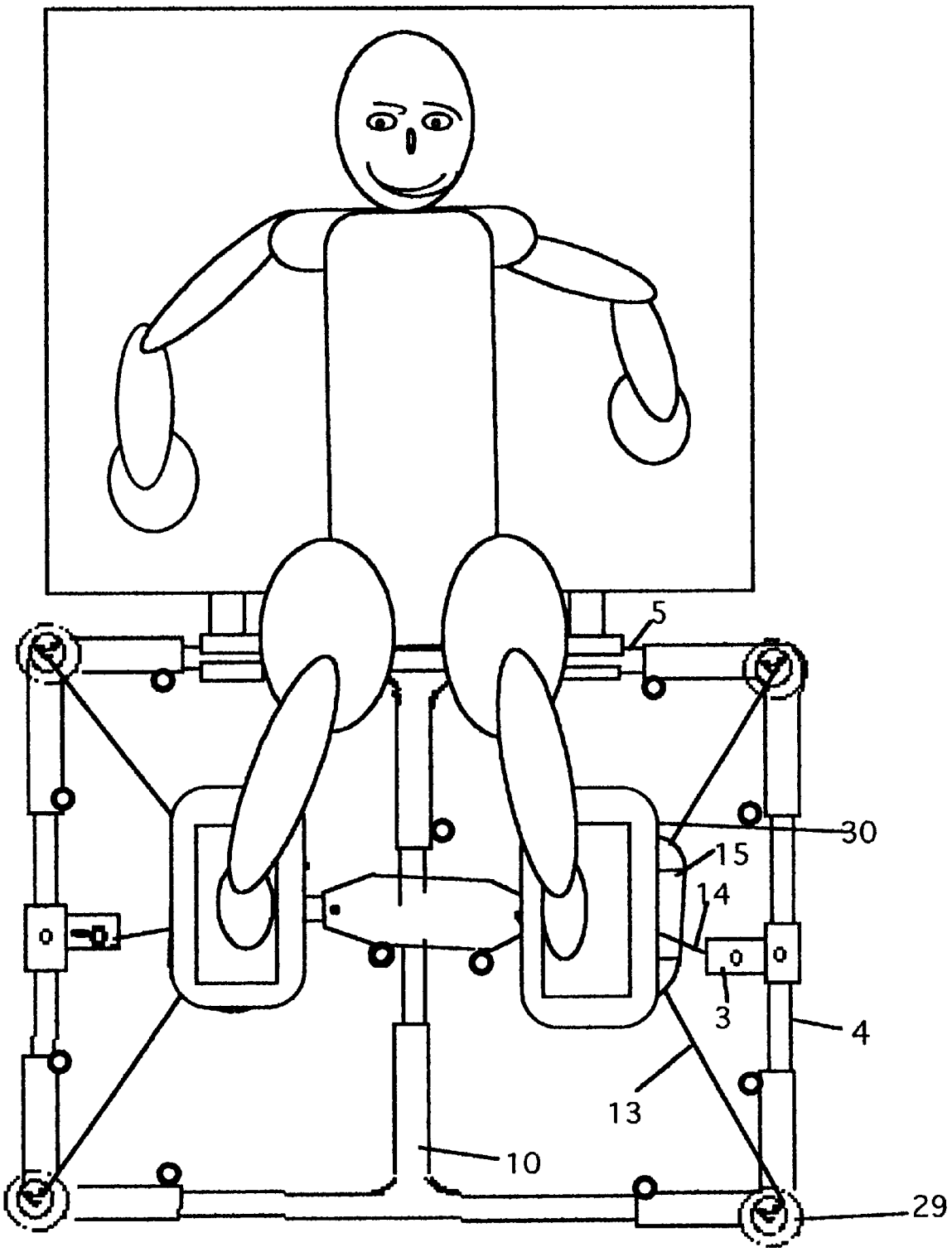
FIG. 8 illustrates a user demonstrating an embodiment of the RotoBar device in a supine position with use of the lower extremities with the foot/knee adapters.

FIG. 8 illustrates a user making use of the aforementioned embodiments of this invention in a supine position. The user's feet are placed on the device using the adapters 30*a* and/or 30*b* attached to the handles by the fasteners 32. The supine position allows user's with more severe back trauma to exercise on the apparatus of the invention in a more stable position with their back on the ground. An optional pad 6*a* could be used in this position. Utilizing this device in the supine position will help strengthen the gluteal muscles, the internal and external rotator muscles of the femur and involved the trunk muscles in pelvic positioning which is key for proper gait sequencing. The base alone could be placed on a patient's bed if they were unable to get to the floor.

Figure 16:
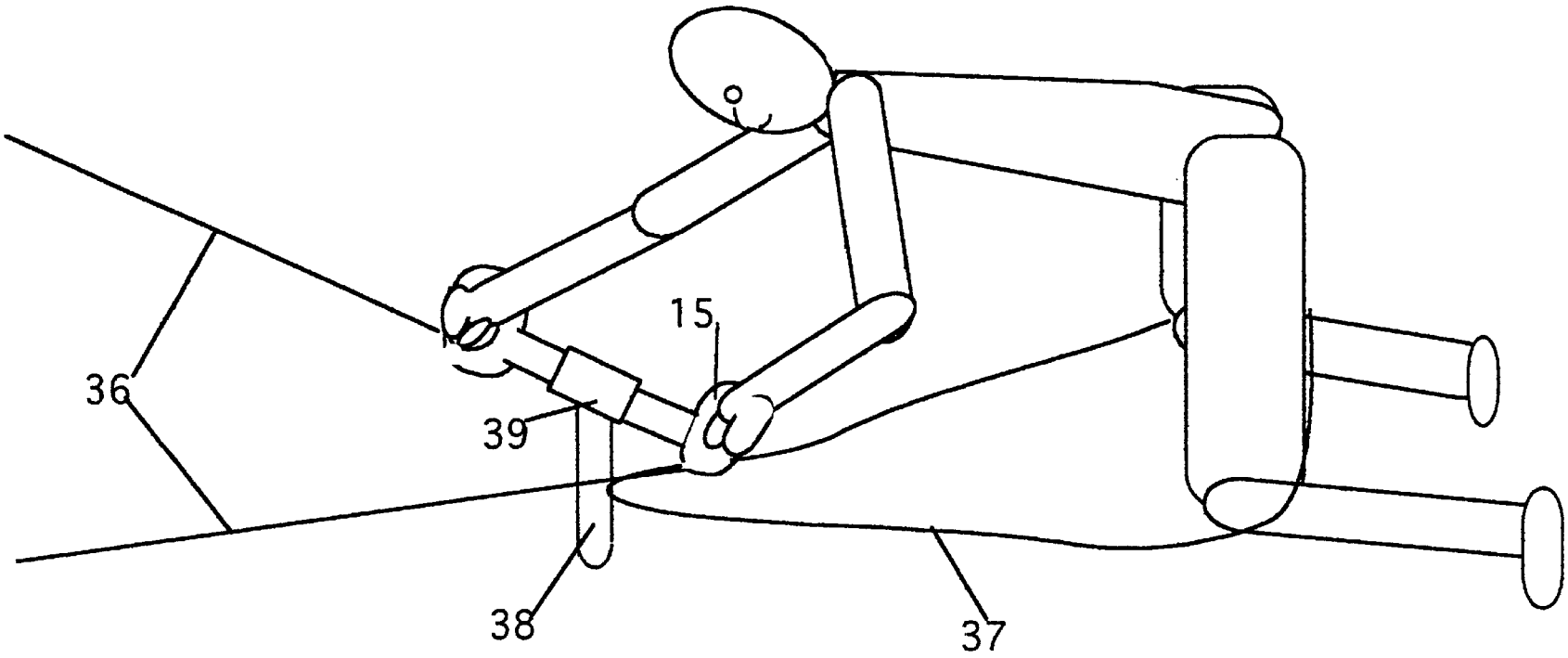
FIG. 16 illustrates a user demonstrating the use of the device displayed in FIG. 15.

This supine position-use could be done with the back flat on the floor or bed or in a bridge position with the buttocks raised off the floor or bed. Stroke patients often suffer from hip protraction, weak gluteal muscles and difficulty moving out of synergy patterns as a result of their stroke. Used in the supine position the embodiments of this invention provide a way of combining hip extension, external/internal rotation, knee flexion and extension and pelvic control in a manner that is presently unavailable. FIG. 16 illustrates a user demonstrating the use of the device attached to the adjustable angle stand 41 that can change the angle and position of the devices to accommodate multiple positions and the ankle, knee and hip when used in a supine position. This invention could also be used on the adjustable angle stand 41 in the quadruped position.

Figure 4B:
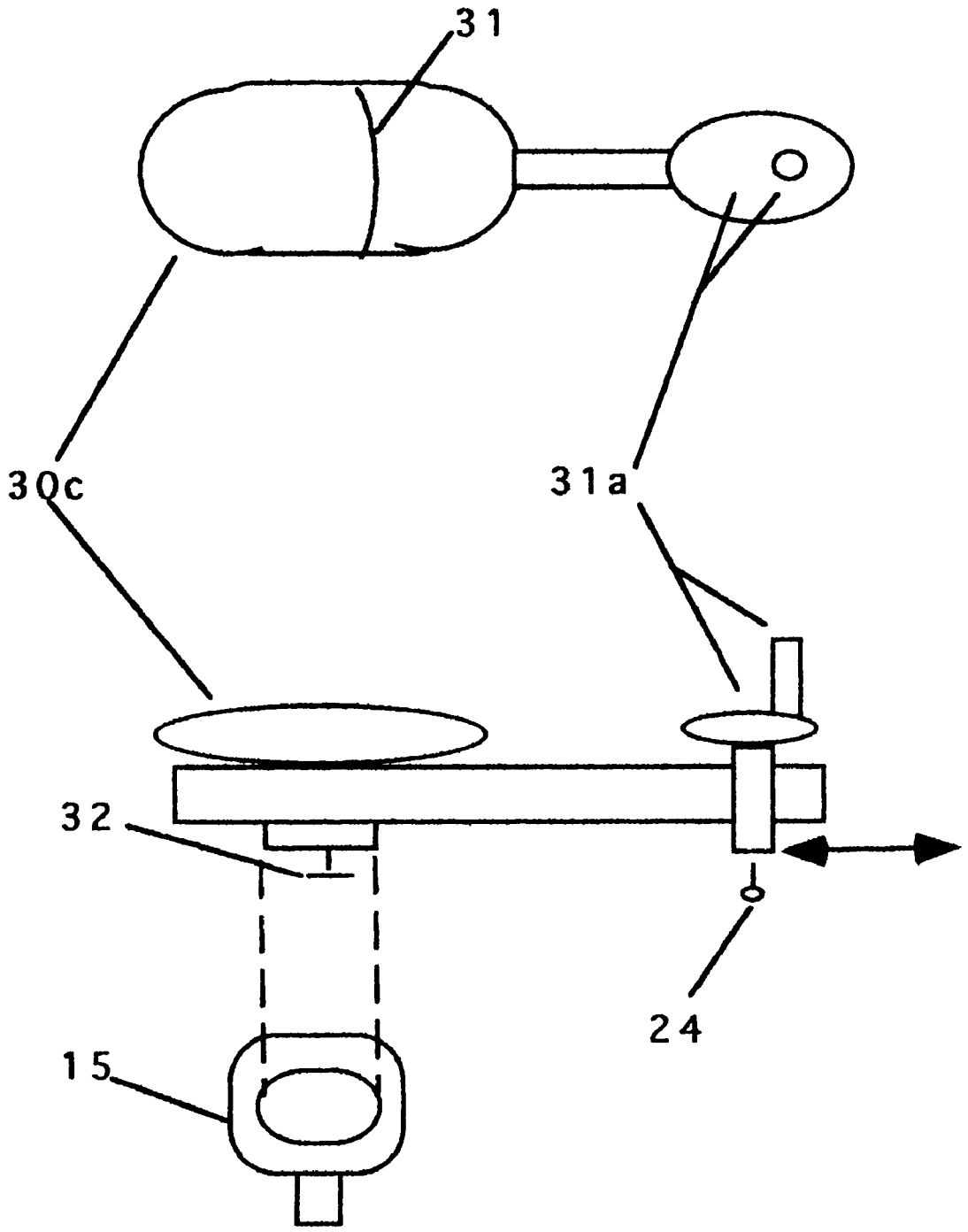
FIG. 4*b* is a perspective view of the forearm adapter and extension riser for the RotoBox device within this invention.
Figure 4C:
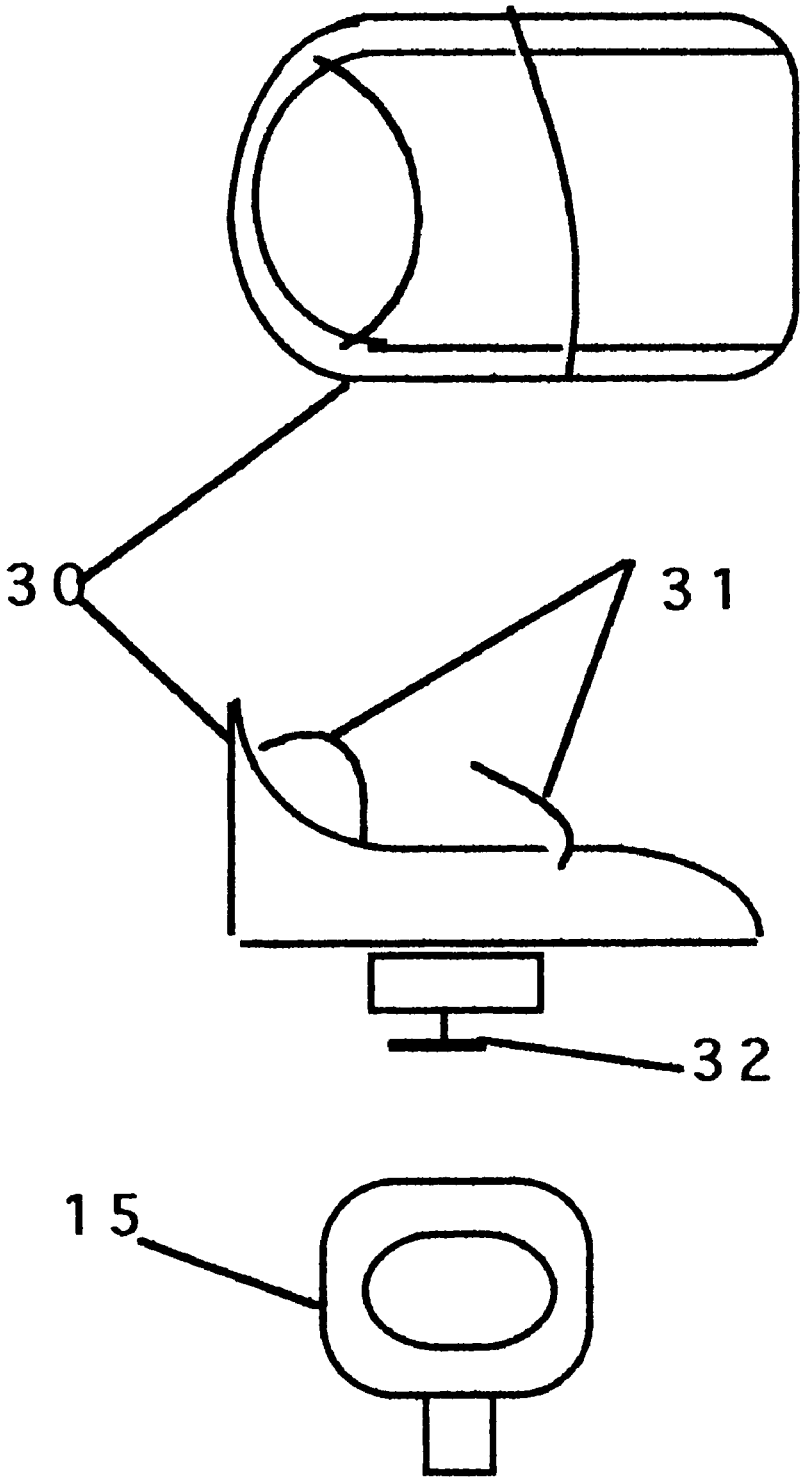
Figure 4D:
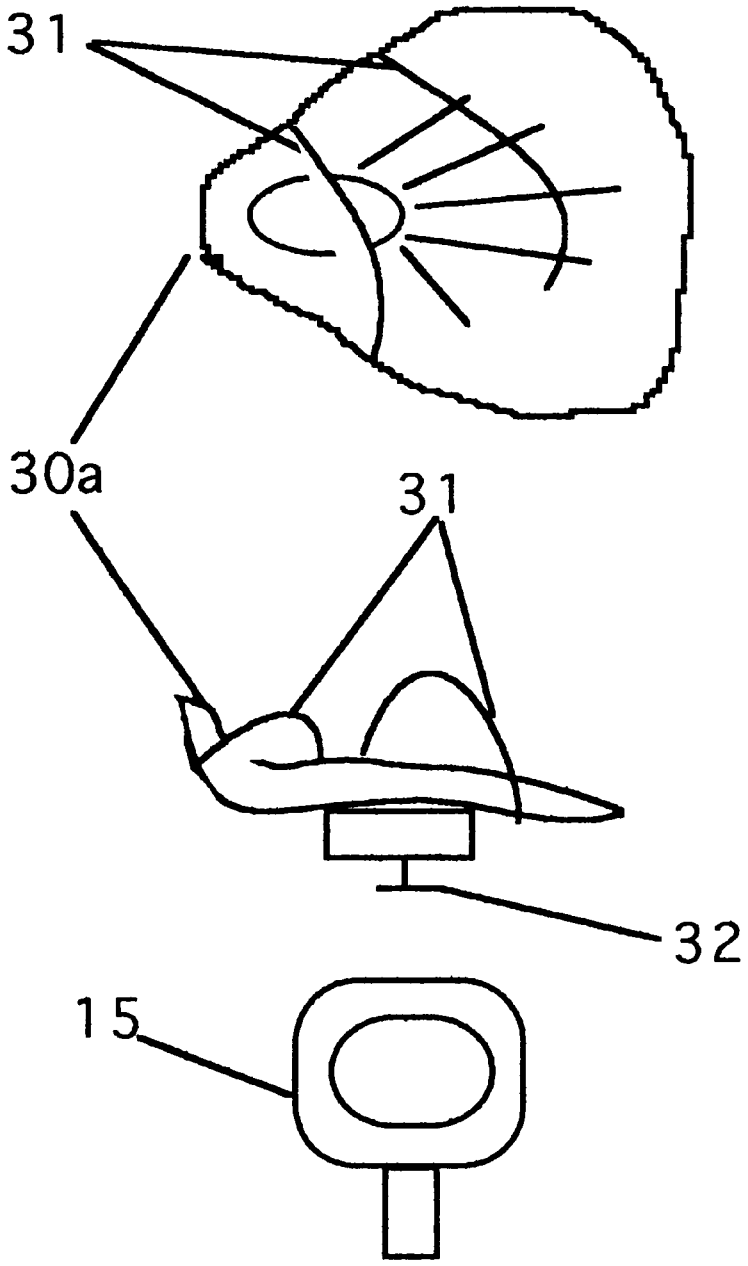
Figure 4E:
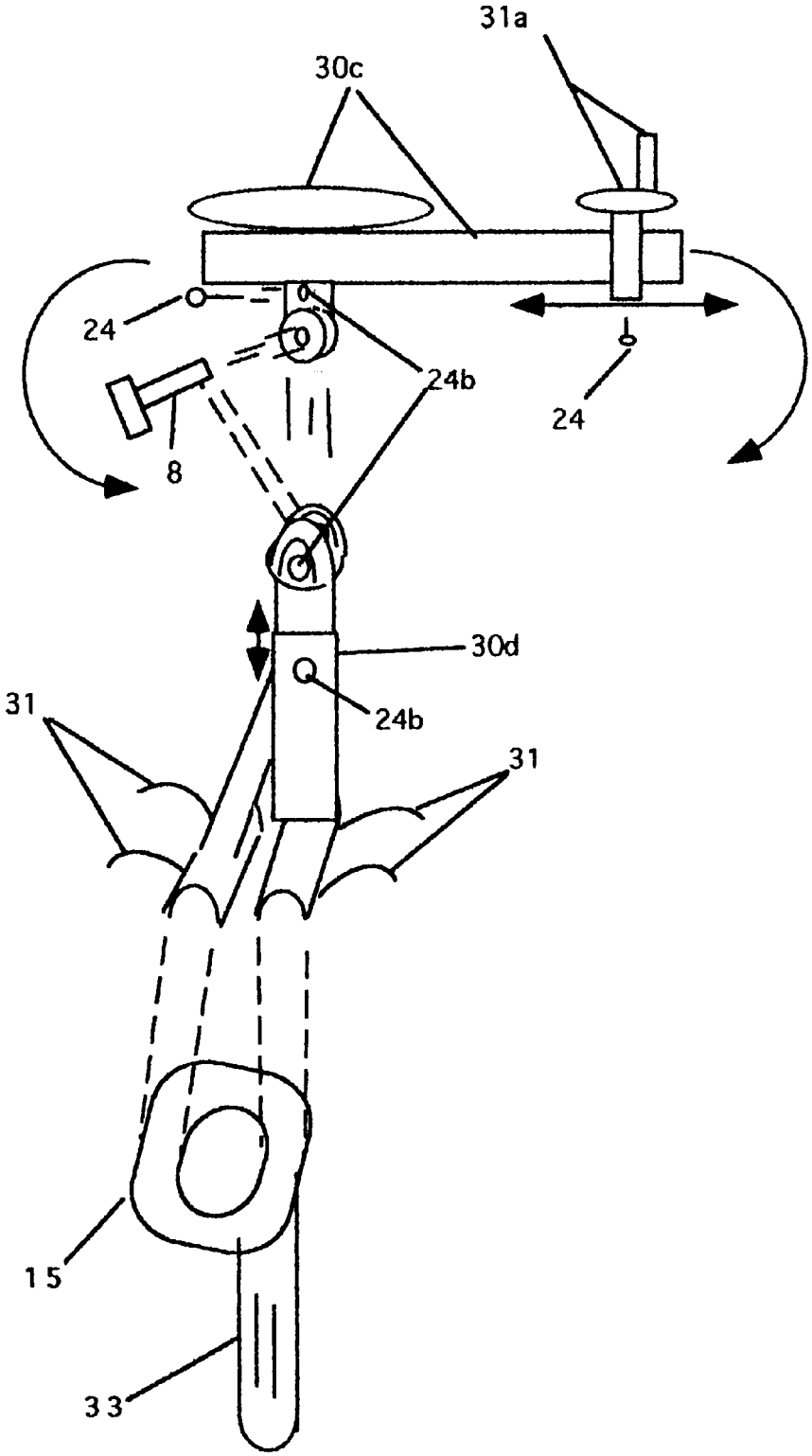

The device illustrated in FIGS. 1–11 can stand alone as a therapeutic tool for rehabilitative exercise, but the use of the device in FIG. 12–15 combines with the aforementioned embodiments to form a system of treatment for shoulder and back injuries. The RotoBox apparatus, shown in FIGS. 12–14, holds many of the same embodiments as the RotoBar. The handles 15 in both inventions were developed around the same concept of rotation occurring about an axis point 8 and not over the axis point. As described above, the handle position, offset from the axis point, allows rotation to occur at the shoulder and not at the forearm. This helps isolate the rotator cuff muscle from those in the forearm. A particular forearm adapter 30*c* option is available and allows people to use the device in multiple positions. A particular embodiment that the forearm adapter 30*c* with hand grip 31*a* facilitates an unweighted range of motion when combined with the ball n' socket option (FIG. 12*b*—ball and shaft 21*c*, lock nut 21*b*, and receptacle 20) with adjustable shaft height to control for the amount of movement freedom at the multi-axial joint. This ball n' socket option is also applicable to the RotoBar device and would further enhance the apparatus's control for variability in a multiplicity of planar movements (see FIG. 3*b*). The specific embodiment of the forearm adapter 30*c* and riser 30*d* for the RotoBox is the hinge joint at the top end of the riser 30*d* illustrated in FIG. 4*b*. The hinge joint allows for a further degree of movement and incorporates translation into the movement option for the RotoBox device. The equivalent embodiment for the RotoBar device is illustrated in FIG. 3*a* and represented as the rotor with hinge option 17*a*. The importance of translation option is that is a functional movement and one we use a simple a task a reaching to put the key in the ignition—that motion can be replicated with the RotoBox and the forearm/riser options 30*c* and 30*d*.

Figure 14:
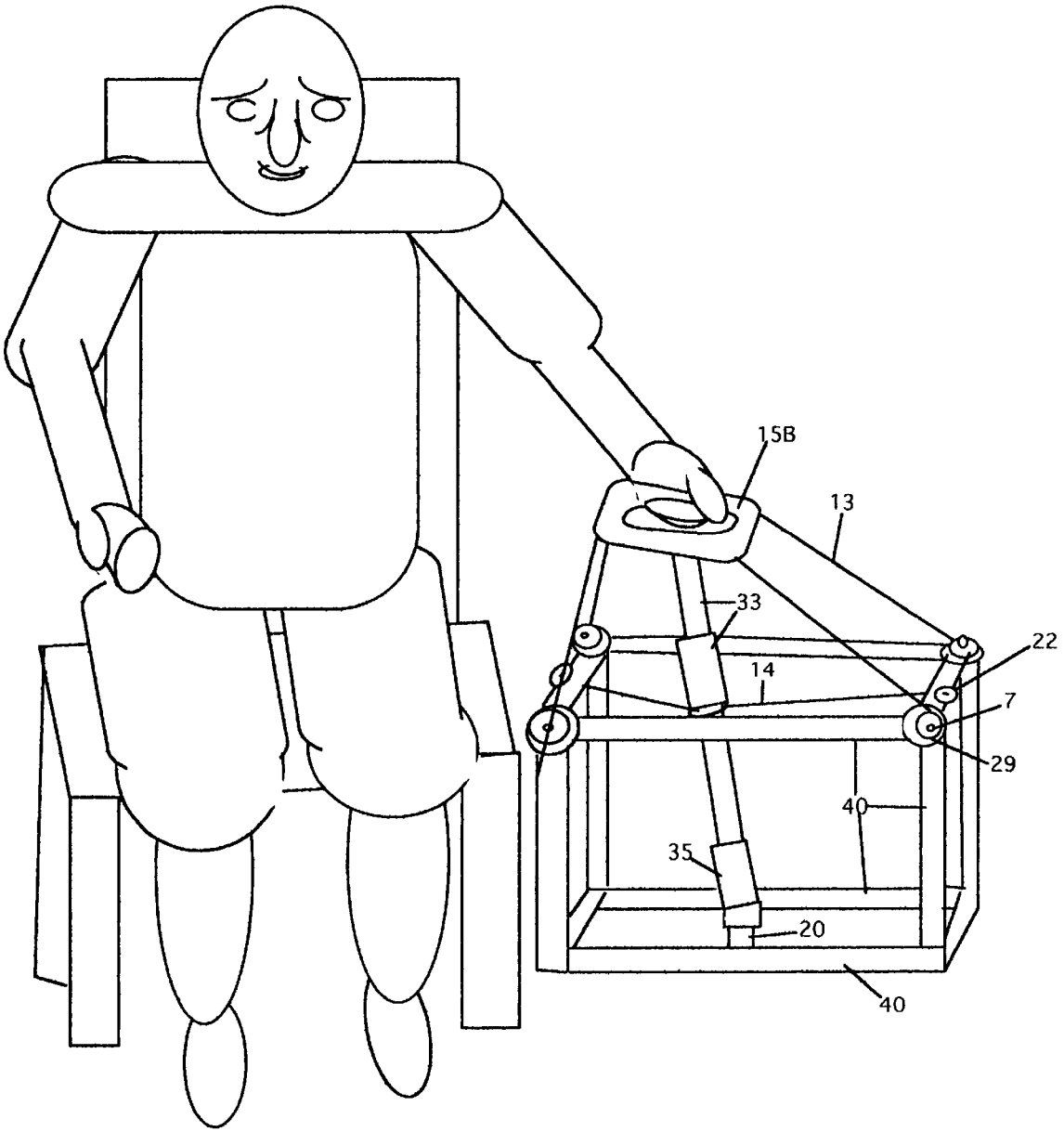
FIG. 14 is a picture taking a front perspective of the user's left arm demonstrating the use of the RotoBox device in FIGS. 12 and 13 that embodies the resistance means 13 and 14, the rotational movement about the handle 15 and shoulder adduction.

FIG. 14 illustrates the RotoBox invention being used while the user is sitting in a chair with the user training one arm at a time. Two devices could be used to train both shoulders simultaneously while facilitating shoulder depression, retraction and a more erect posture.

Figure 12:
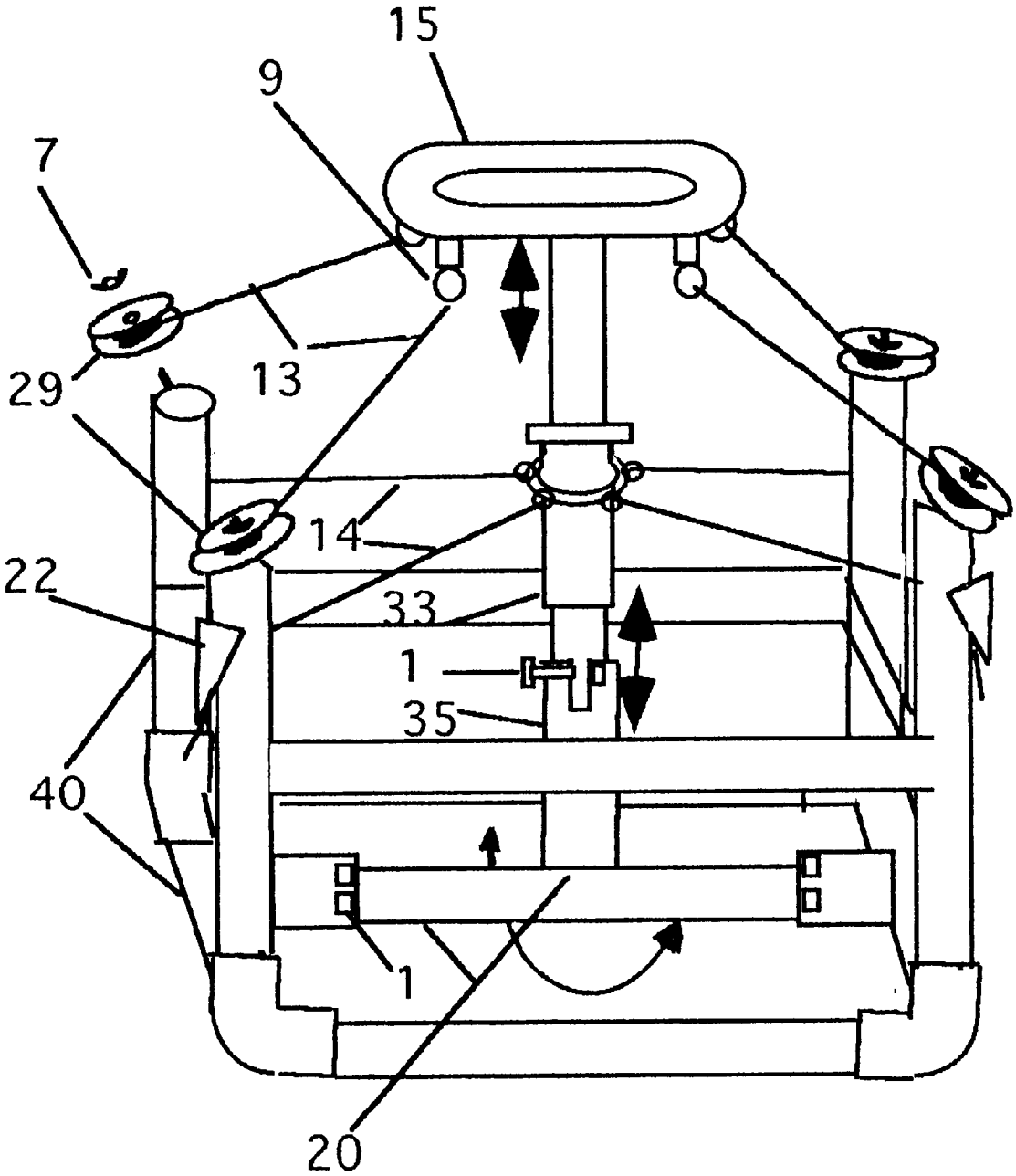
FIG. 12 is a perspective of the RotoBox device that embodies unilateral shoulder depression, abduction, adduction and internal and external rotation.
Figure 12A:
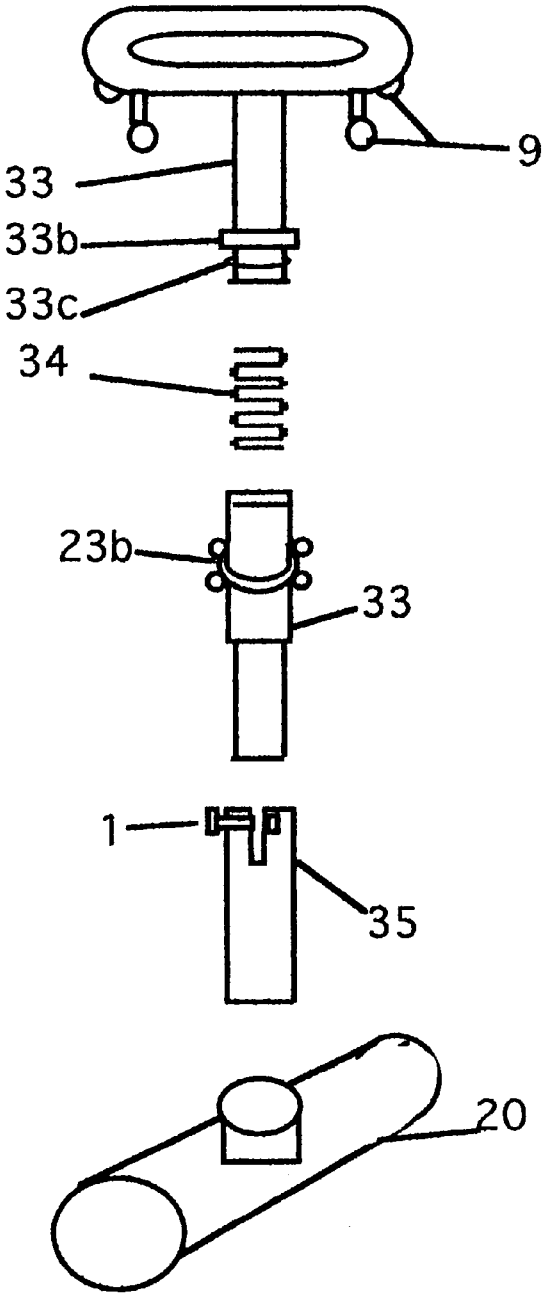
FIG. 12*a* is an exploded view of the moveable components of the RotoBox.
Figure 12B:
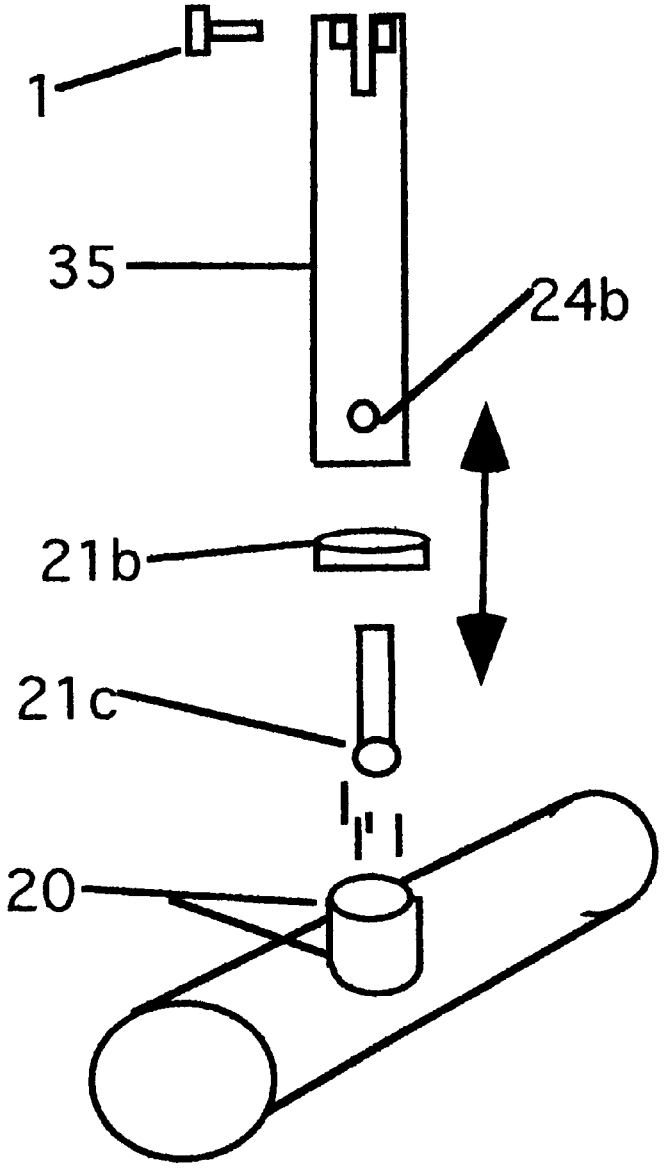
FIG. 12*b* is an exploded view of a multi-axial 'ball n' socket joint option for the riser 35 component of the RotoBox.
Figure 13:
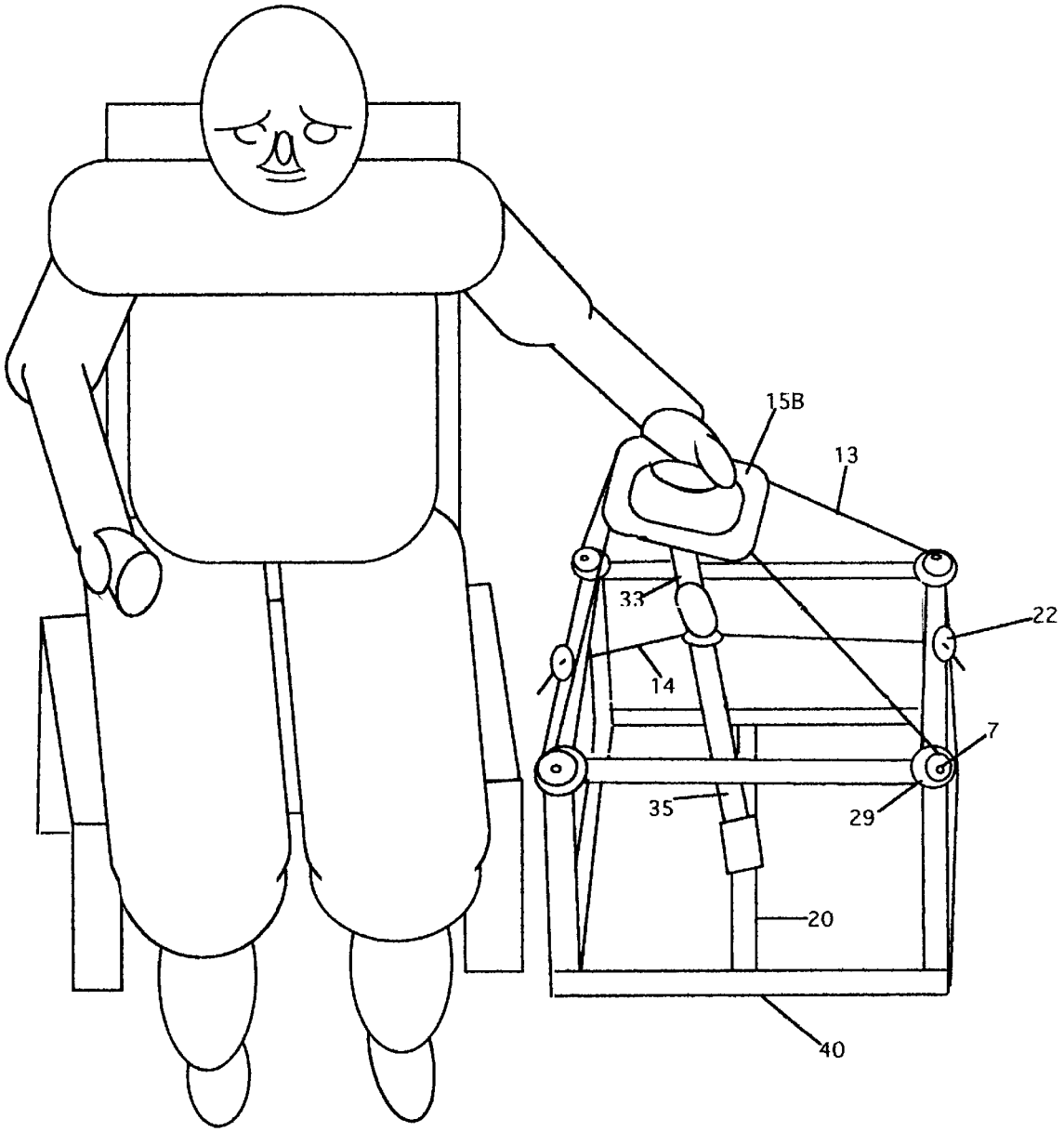
FIG. 13 is a picture looking down on the users left arm demonstrating the use of the RotoBox device in FIG. 12 that embodies the elastic tubing 13, the rotational movement about the handle 15 and shoulder adduction.

FIGS. 12–14 capture some of the unique embodiments of this aspect of the system. The RotoBox utilizes scapular depression to elicit the approximating force, instead of weight bearing, as demonstrated with the RotoBar in FIGS. 6–7. This depression occurs as the user pushes down on the handle that compresses the spring 34 within the down tube slide-couple 33. Different resistance springs 34 could be placed in the down tube coupler 33 to provide a variable resistance to shoulder depression. The top and bottom portion of the coupler 33 is secured by the locking coupler cap 33*b* and a rubber washer 33*c* is used to reduce joint play within slide coupler 33. The handle width, the distance off-set from the axis point, may be adjustable with a sliding handle (not illustrated). The height of the handle is adjustable through the down tube 33 that can move up and down inside the riser 35 which is attached to the T-tube 20 which allows for abduction and adduction of the shoulder. The down tube is held in place by a C-clamp 1*b* unit at the top of riser 35. The resistance in the RotoBox embodiment of FIGS. 12–14 is the same as in the RotoBar illustrated in FIGS. 1–11 which can utilize elastic tubing or be adapted to a pulley system with weights. The resistive tubing or cable 13 is attached to the handles 15 via eyelet 9 and anchored to the base 40 through the tension spools 29 at apex the base's corners and the tension is maintained on 29 through tightening of wing nut 7. The resistive tubing or cable 14 is attached to the riser coupler 33 via eyelet 23*b* and is secured to each of the four vertical members of the base 40 and held secure via tension clips 22. The benefit of the RotoBox when used in conjunction with the RotoBar is that the RotoBox isolates shoulder use and scapular stabilization and provides an alternative mode of applying weight bearing force through the shoulder complex and may be a suitable device for more acute shoulder injuries. The RotoBox allows rehabilitation to occur about the shoulder complex while the upper extremity can remain near neutral.

Figure 15:
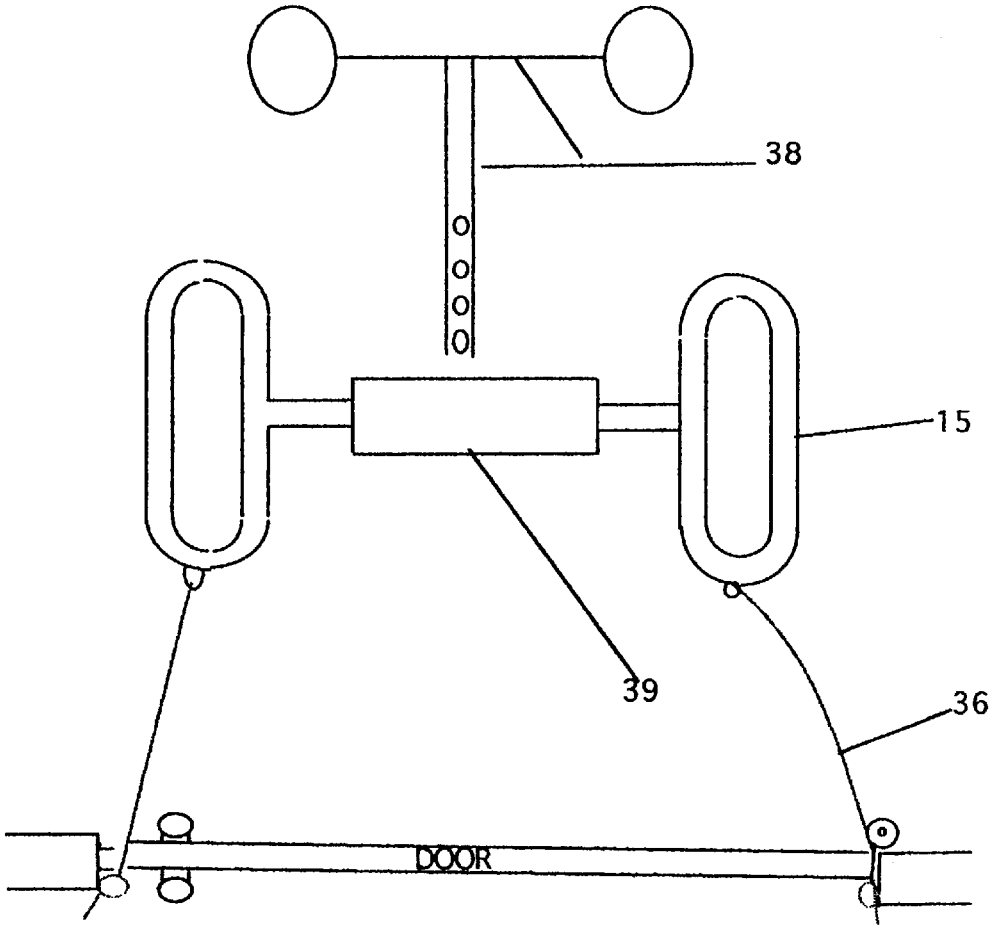
FIG. 15 is a top and side view perspective of the RotoBar Traveler, a device that is a smaller, more portable version of the RotoBar device displayed in FIGS. 1–11.
Figure 15:
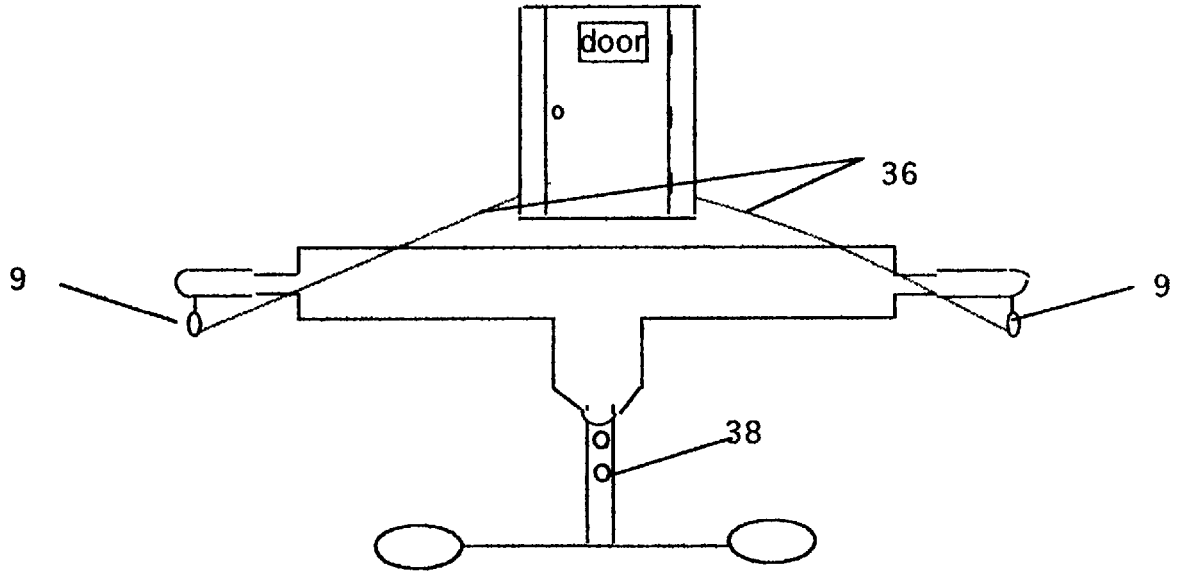

FIGS. 15–16 represent a preferred embodiment of the RotoBar shown in FIGS. 1–11. FIG. 15 is a compact version of the invention shown in FIG. 1 and acts on the same principles and basic design as the device displayed in FIGS. 1–11 but does not have the longitudinal axis 20 movement nor the satellite rotational components 8, 25, 18. The rotor complex 39 of this device is fixed to handles 15 unlike the device in FIGS. 1–11. In FIG. 15 the counter-force bracket 38 locks in a pivot point that counter acts the forward pull of the resistance means 36. While the RotoBar (FIGS. 1–11) is portable, its size could prohibit a traveling person from carrying it with them on trips that take them away from home. The RotoTraveler™ of FIGS. 15 and 16 is an important adjunct to the device in FIG. 1–11 because it will allow the user the greatest opportunity in all personal situations to benefit from the above-described advantageous movement patterns.

Components of every embodiment of the present inventive system, except the bearings, could be manufactured using steel, aluminum alloys, graphite, or reinforced plastics. For durability, in the preferred embodiment the handle and rotor system demonstrated in FIG. 3 would be made of metal or composite tubing similar to that used in the manufacture of bicycles. The base and the handles could be manufactured using reinforced plastics, graphite and or composite material. The variety of the different possibilities of materials would change only the cost and strength of the invention and would not affect the movement of any of the major embodiments herein disclosed. Resistance could also be provided via a weight-pulley system—this resistance means option is not illustrated.

It will be evident that there are numerous embodiments of the apparatus of this invention which are not described above but which are clearly within the scope and spirit of this system. Consequently, the above description is intended to be exemplary only. The spirit and scope of the invention should be limited only as set forth in the claims which follow.

What is claimed is:

1. An exercise apparatus providing multi-axial, non-linear movement, said apparatus comprising:

(a) a plurality of handles;

(b) a horizontal member movably connected to said handles and comprising a means for allowing movement of said handles through a plurality of movement planes;

(c) a vertical member movably connected perpendicular to said horizontal member and vertically supporting said horizontal member for movement of said horizontal member about said vertical member;

(d) a base, movably connected to said vertical member for securing said vertical member and supporting said horizontal member to enable movement of said horizontal member and said handles from either a fixed distance from said base or an angle parallel to said base;

(a) each of said handles being movably connected to said horizontal member by a pivot bar providing a means for each of said handles to move in an arc independently about said horizontal member, enabling each of said handles to move in a plurality of patterns about said vertical member.

2. The apparatus of claim 1, wherein said handles are movably secured to said pivot bar, enabling rotary movement of said handles about the long axis of said pivot bar and allowing for movement of a user's wrist ulnar and radial deviation.

3. The apparatus of claim 1, wherein said vertical member includes a lower end movably connected to a ball portion of a ball-and-socket joint, said joint having an adjustable range of motion, that is movably connected with the socket portion of the moveable horizontal member of said base, thereby enabling a plurality of movements of said vertical member relative to said base and enabling controlled movement in a plurality of directions of said horizontal member and said handles.

4. The apparatus of claim 1, wherein said horizontal member and said moveable vertical member comprise a hinge connection, providing an axis point perpendicular to said vertical member resulting in translatory movement of said horizontal member relative to said base.

5. The apparatus of claim 1, wherein an adjustable angle stand attaches to a bottom surface of said base, enabling the changing of a plane wherein said base lies, and further enabling the user to achieve a plurality of angles while exercising.

6. The apparatus of claim 1, further comprising resistance means for adjusting levels of force/work load connected to and adjustable between said base and said handles, and between said base and said horizontal member.

7. The apparatus of claim 6, wherein said resistance means comprises a moveable carriage and tension spool that controls an angle of pull of said resistance means from each said horizontal member, thereby designating the location of a maximum resistance point at any desired point in the motion of either of said horizontal member and said handles.

8. A mutiplanar exercise means for use with a user's extremity, comprising:

(a) a handle;

(b) a vertical member off-set and movably connected to said handle whereby isolated shoulder retooling is facilitated;

(d) a substantially cube-shaped base, including a moveable horizontal cross-beam connected to said vertical member for securing said vertical member to said base, enabling movement of said handle out of a plane parallel to said base; and resistance means wherein an interchangeable spring is vertically oriented within said vertical member through a coupling joint to provide an adjustable means for vertical resistance to downward movement of the handle along a long axis of the vertical member whereby anatomical movement of a user includes shoulder depression.

9. A mutiplanar exercise means for use with a user's extremity, comprising:

(a) a handle;

(b) a vertical member off-set and movably connected to said handle whereby isolated shoulder rotation is facilitated;

(d) a substantially cube-shaped base, including a moveable horizontal cross-beam connected to said vertical member for securing said vertical member to said base, enabling movement of said handle out of a plane parallel to said base;

wherein said vertical member comprises two-part female/male means for adjusting the height of said handle to accommodate a plurality of user arm lengths, said vertical member comprising a male portion and secured in place with a "C"-shaped clamp connected to a female portion of said vertical member.

10. A mutiplanar exercise means for use with a user's extremity, comprising:

(a) a handle;

(b) a vertical member off-set and movably connected to said handle whereby isolated shoulder rotation is facilitated;

(d) a substantially cube-shaped base, including a moveably horizontal cross-beam connected to said vertical member for securing said vertical member to said base enabling movement of said handle out of a plane parallel to said base;

wherein said handle comprises a vertical extension apparatus movably secured to a forearm adapter, and said forearm adapter and said vertical extension apparatus comprise a hinge connection means providing an additional axis point perpendicular to said vertical extension, enabling translatory movement of said forearm adapter relative to said base.

11. An exercise apparatus providing multi-axial, non-linear movement, said apparatus comprising:

(a) a plurality of handles;

(b) a horizontal member movably connected to said handles and comprising a means for allowing movement of said handles through a plurality of movement planes;

(c) a vertical member movably connected perpendicular to said horizontal member and vertically supporting said horizontal member for movement of said horizontal member about said vertical member;

(d) a base, movably connected to said vertical member for securing said vertical member and supporting said horizontal member to enable movement of said horizontal member and said handles from either a fixed distance from said base or an angle parallel to said base;

(e) each of said handles being movably connected to said horizontal member by a pivot bar providing a means for each of said handles to move in an arc independently about said horizontal member, thereby enabling each of said handles to pivot about at least three axes of rotation.

12. The apparatus of claim 11, wherein said handles are movably secured to said pivot bar, enabling rotary movement of said handles about the long axis of said pivot bar and allowing for movement of a user's wrist ulnar and radial deviation.

13. The apparatus of claim 11, wherein said vertical member includes a lower end movably connected to a ball portion of a ball-and-socket joint, said joint having an adjustable range of motion, that is movably connected with the socket, portion of the moveable horizontal member of said base, thereby enabling a plurality of movements of said vertical member relative to said base and enabling controlled movement in a plurality of directions of said horizontal member and said handles.

14. The apparatus of claim 11, wherein said horizontal member and said moveable vertical member comprise a hinge connection, providing an axis point perpendicular to said vertical member resulting in translatory movement of said horizontal member relative to said base.

15. The apparatus of claim 11, wherein an adjustable angle stand attaches to a bottom surface of said base, enabling the changing of a plane wherein said base lies, and further enabling the user to achieve a plurality of angles while exercising.

16. The apparatus of claim 11, further comprising resistance means for adjusting levels of force/work load connected to and adjustable between said base and said handles, and between said base and said horizontal member.

17. The apparatus of claim 16, wherein said resistance means comprises a moveable carriage and tension spool that controls an angle of pull of said resistance means from each said horizontal member thereby designating the location of a maximum resistance point at any desired point in the motion of either of said horizontal member and said handles.

* * * * *